US010082743B2

(12) United States Patent
Hama et al.

(10) Patent No.: US 10,082,743 B2
(45) Date of Patent: Sep. 25, 2018

(54) TONER

(71) Applicant: CANON KABUSHIKI KAISHA, Tokyo (JP)

(72) Inventors: Masayuki Hama, Toride (JP); Hideki Kaneko, Yokohama (JP); Takeshi Hashimoto, Moriya (JP); Ichiro Kanno, Kashiwa (JP); Nozomu Komatsu, Toride (JP); Takakuni Kobori, Toride (JP); Hiroyuki Fujikawa, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/176,541

(22) Filed: Jun. 8, 2016

(65) Prior Publication Data

US 2016/0363877 A1 Dec. 15, 2016

(30) Foreign Application Priority Data

Jun. 15, 2015 (JP) ..... 2015-120189
May 31, 2016 (JP) ..... 2016-108580

(51) Int. Cl.
*G03G 9/087* (2006.01)
*G03G 9/08* (2006.01)

(52) U.S. Cl.
CPC ..... *G03G 9/08755* (2013.01); *G03G 9/0825* (2013.01); *G03G 9/08795* (2013.01); *G03G 9/08797* (2013.01)

(58) Field of Classification Search
CPC ..... G03G 9/08755; G03G 9/08797; G03G 9/0825; G03G 9/08795
See application file for complete search history.

(56) References Cited

U.S. PATENT DOCUMENTS 5,424,810 A 6/1995 Tomiyama et al.
5,464,722 A 11/1995 Tomiyama et al.
5,700,616 A 12/1997 Kasuya et al.
5,712,073 A 1/1998 Katada et al.
(Continued)

FOREIGN PATENT DOCUMENTS

JP 2003-270856 A 9/2003
JP 2004-279476 A 10/2004
(Continued)

OTHER PUBLICATIONS

U.S. Appl. No. 15/179,489, Masayuki Hama, Jun. 10, 2016.

*Primary Examiner* — Thorl Chea
(74) *Attorney, Agent, or Firm* — Fitzpatrick, Cella, Harper & Scinto

(57) ABSTRACT

A toner comprising a toner particle containing a crystalline polyester resin and an amorphous polyester resin, wherein, in a cross-sectional observation of the toner by transmission electron microscopy (TEM), the number-average diameter (D1) of major axis lengths of the crystalline polyester resin dispersed up to a depth of 0.30 μm from a toner surface is 40 nm to 110 nm, and the number-average diameter (D1) of major axis lengths of the crystalline polyester resin dispersed deeper than 0.30 μm from the toner surface is 1.25 to 4.00 times the number-average diameter (D1) of the major axis lengths of the crystalline polyester resin dispersed up to a depth of 0.30 μm from the toner surface.

3 Claims, 4 Drawing Sheets

(56) References Cited

U.S. PATENT DOCUMENTS

| | | | |
|---|---|---|---|
| 5,968,701 | A | 10/1999 | Onuma et al. |
| 5,972,553 | A | 10/1999 | Katada et al. |
| 6,002,895 | A | 12/1999 | Kasuya et al. |
| 6,007,957 | A | 12/1999 | Kobori et al. |
| 6,020,102 | A | 2/2000 | Fujimoto et al. |
| 6,120,961 | A | 9/2000 | Tanikawa et al. |
| 6,156,471 | A | 12/2000 | Kobori et al. |
| 6,203,959 | B1 | 3/2001 | Tanikawa et al. |
| 6,235,441 | B1 | 5/2001 | Tanikawa et al. |
| 6,430,384 | B2 | 8/2002 | Hama et al. |
| 6,653,036 | B1 | 11/2003 | Tanikawa et al. |
| 6,670,087 | B2 | 12/2003 | Fujikawa et al. |
| 6,751,424 | B2 | 6/2004 | Komatsu et al. |
| 6,808,852 | B2 | 10/2004 | Hotta et al. |
| 7,112,395 | B2 | 9/2006 | Ida et al. |
| 7,135,263 | B2 | 11/2006 | Kawakami et al. |
| 7,147,980 | B2 | 12/2006 | Itakura et al. |
| 7,147,981 | B2 | 12/2006 | Fujikawa et al. |
| 7,229,727 | B2 | 6/2007 | Itakura et al. |
| 7,279,262 | B2 | 10/2007 | Fujikawa et al. |
| 7,288,348 | B2 | 10/2007 | Hayami et al. |
| 7,297,455 | B2 | 11/2007 | Fujikawa et al. |
| 7,300,733 | B2 | 11/2007 | Sugahara et al. |
| 7,396,626 | B2 | 7/2008 | Fujikawa et al. |
| 7,396,629 | B2 | 7/2008 | Baba et al. |
| 7,442,478 | B2 | 10/2008 | Itakura et al. |
| 7,452,647 | B2 | 11/2008 | Hayami et al. |
| 7,611,813 | B2 | 11/2009 | Ida et al. |
| 7,855,042 | B2 | 12/2010 | Kobori et al. |
| 7,858,283 | B2 | 12/2010 | Ishigami et al. |
| 7,927,775 | B2 | 4/2011 | Komatsu et al. |
| 7,939,233 | B2 | 5/2011 | Inoue et al. |
| 8,137,886 | B2 | 3/2012 | Baba et al. |
| 8,142,972 | B2 | 3/2012 | Hotta et al. |
| 8,288,069 | B2 | 10/2012 | Fujikawa et al. |
| 8,524,434 | B2 | 9/2013 | Tominaga et al. |
| 8,735,037 | B2 | 5/2014 | Yamshita et al. |
| 8,921,023 | B2 | 12/2014 | Baba et al. |
| 8,927,188 | B2 | 1/2015 | Naka et al. |
| 8,986,914 | B2 | 3/2015 | Fujikawa et al. |
| 9,034,549 | B2 | 5/2015 | Shiotari et al. |
| 9,058,924 | B2 | 6/2015 | Komatsu et al. |
| 9,063,443 | B2 | 6/2015 | Ishigami et al. |
| 9,152,088 | B1 | 10/2015 | Kobori et al. |
| 9,256,148 | B2 | 2/2016 | Fujikawa et al. |
| 9,348,253 | B2 | 5/2016 | Kanno et al. |
| 9,372,420 | B2 | 6/2016 | Mizo et al. |
| 2008/0107991 | A1* | 5/2008 | Hamano ..... G03G 9/0804 430/109.4 |
| 2009/0246675 | A1 | 10/2009 | Nakamura et al. |
| 2010/0028796 | A1 | 2/2010 | Nakamura et al. |
| 2010/0183971 | A1 | 7/2010 | Fujikawa et al. |
| 2011/0086301 | A1* | 4/2011 | Cheng ..... G03G 9/08755 430/105 |
| 2013/0244159 | A1 | 9/2013 | Ishigami et al. |
| 2014/0096409 | A1 | 4/2014 | Ohtsu et al. |
| 2014/0101966 | A1 | 4/2014 | Minagawa et al. |
| 2014/0134535 | A1 | 5/2014 | Baba et al. |
| 2014/0137428 | A1 | 5/2014 | Takenaka et al. |
| 2014/0329176 | A1 | 11/2014 | Kanno et al. |
| 2015/0086917 | A1 | 3/2015 | Iwasaki et al. |
| 2015/0177634 | A1 | 6/2015 | Kamae et al. |
| 2015/0185650 | A1 | 7/2015 | Hahimoto et al. |
| 2016/0109820 | A1 | 4/2016 | Hashimoto et al. |

FOREIGN PATENT DOCUMENTS

| | | | |
|---|---|---|---|
| JP | 2011-145587 | A | 7/2011 |
| JP | 2011-197274 | A | 10/2011 |
| JP | 2012-018391 | A | 1/2012 |
| JP | 2012-063559 | A | 3/2012 |

* cited by examiner

TONER

BACKGROUND OF THE INVENTION

Field of the Invention

The present invention relates to a toner for use in electrophotographic systems, electrostatic recording systems, electrostatic printing systems and toner jet systems.

Description of the Related Art

As electrophotographic full-color copiers have become popular in recent years, there has been increasing demand for higher printing speeds and energy savings. To achieve higher printing speeds, techniques are being investigated for melting the toner more rapidly during the fixing process. Further, to save energy, techniques are being investigated for fixing the toner at lower fixation temperatures so as to reduce power consumption during the fixing process.

Recently, toners containing crystalline polyester resin in the binder resin have been developed as a way of improving the low-temperature fixability of the toner. By including a crystalline polyester in the toner, it is possible to improve storage stability and durability because the toner melts rapidly at the fixation temperature but maintains its hardness up to the fixation temperature.

Because adding a crystalline polyester to a toner confers various properties on the toner including a sharp melt property, various techniques have been proposed for exploiting the advantages of these properties or minimizing their disadvantages.

Japanese Patent Application Publication No. 2003-270856 discloses a toner manufacturing technique exploiting the sharp melt property, and describes a method for obtaining a toner with a high degree of circularity by including a crystalline polyester and heat treating the toner, resulting in a toner with excellent transferability.

In Japanese Patent Application Publication No. 2012-63559 a crystalline polyester dispersing agent is used in addition to the principal binder resin and crystalline polyester, and the solubility parameters of each are defined. The object here is to reduce exposure of the crystalline polyester on the toner surface layer, and finely disperse the crystalline polyester in the interior of the toner particles, thereby controlling toner filming on other members and improving hot offset resistance.

Japanese Patent Application Publication No. 2012-18391 proposes a toner containing a finely dispersed crystalline resin, in which the surface layer of the toner particles is covered with an amorphous resin. Heat-resistant storage stability and durable stability are thus achieved in a toner with excellent low-temperature fixability containing a crystalline polyester.

Japanese Patent Application Publication No. 2011-145587 proposes improving fixing separability by stipulating the relationship between the cross-sectional area of the crystal domains of the crystalline polyester and the cross-sectional area of the domains of the release agent in a toner. The speed at which the wax seeps to the surface of the toner is thus optimally balanced with the melting speed of the toner binder resin, resulting in both low-temperature fixability and good fixing separability.

Japanese Patent Application Publication No. 2004-279476 proposes improving hot offset resistance by giving the crystals of the crystalline polyester in the toner a major axis diameter of at least 0.5 μm and no more than ½ the diameter of the toner.

In Japanese Patent Application Publication No. 2011-197274, low-temperature fixability is improved by distributing the crystalline polyester preferentially as a lamellar layer on the surface of the toner.

As illustrated by the techniques disclosed here, the properties of a toner are greatly affected by the state of the crystalline polyester in the toner, and controlling this state is one of the important techniques for maximally exploiting the performance of the crystalline polyester. These disclosures also suggest that when a crystalline polyester is present in the surface layer of a toner in particular, there is be a trade-off between advantages in terms of fixability and the like and disadvantages in terms of durability. There is therefore demand for toner technology whereby the toner properties other than fixability can be improved while taking advantage of the superior fixability provided by the crystalline polyester.

SUMMARY OF THE INVENTION

It is an object of the present invention to provide a toner that solves these problems. Specifically, the object is to provide a toner that provides both low-temperature and high-temperature fixability, while having high developability obtained by exploiting the physical properties of a crystalline polyester.

The present invention is a toner comprising a toner particle containing a crystalline polyester resin and an amorphous polyester resin, wherein in a cross-sectional observation of the toner by transmission electron microscopy (TEM), the number-average diameter (D1) of major axis lengths of the crystalline polyester resin dispersed up to a depth of 0.30 μm from a toner surface is from 40 nm to 110 nm, and the number-average diameter (D1) of major axis lengths of the crystalline polyester resin dispersed deeper than 0.30 μm from the toner surface is from 1.25 to 4.00 times the number-average diameter (D1) of the major axis lengths of the crystalline polyester resin dispersed up to a depth of 0.30 μm from the toner surface.

A toner having high developing performance as well as good low-temperature and high-temperature fixing performance can be provided by the present invention.

Further features of the present invention will become apparent from the following description of exemplary embodiments (with reference to the attached drawings).

DESCRIPTION OF THE EMBODIMENTS

Figure 1:
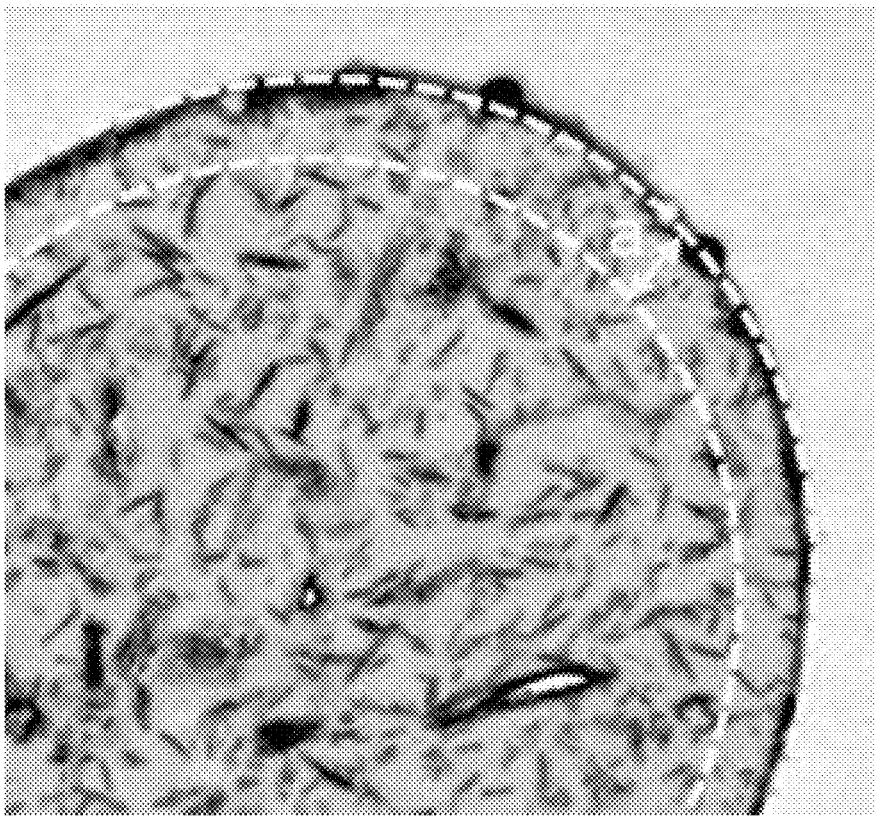
FIG. 1 is a toner cross-section showing the toner of the invention under a transmission electron microscope (TEM)

In the toner of the invention, it is important that the number-average diameter (D1) of major axis lengths of the crystalline polyester resin dispersed up to a depth of 0.30 μm from the toner surface (in the toner surface layer) be 40 nm to 110 nm, and that the number-average diameter (D1) of major axis lengths of the crystalline polyester resin dispersed deeper than 0.30 μm from the toner surface (in the toner interior) be 1.25 to 4.00 times the number-average diameter (D1) of the major axis lengths of the crystalline polyester resin dispersed up to a depth of 0.30 μm from the toner surface.

By giving the crystals of the crystalline polyester in the toner surface layer a smaller major axis diameter and the crystals of the crystalline polyester in the toner interior a larger major axis diameter, it is possible to exploit the properties of the crystalline polyester to confer superior developability and fixability on the toner.

The inventors have studied the mechanisms of this.

Crystalline polyester crystals having a specific length in the toner can improve low-temperature fixability because of their sharp melt property.

However, crystalline polyester has less electrical resistance than amorphous polyester, and lower charging performance. Thus, if large crystal domains of the crystalline polyester are present in the toner surface layer, they may cause variation in the surface charge of the toner.

When this is addressed by forming the toner surface layer from materials that do not include a crystalline polyester, low-temperature and high-temperature fixability are likely to decline. When a resin consisting of the crystalline polyester completely compatibilized with the amorphous polyester is formed in the surface layer, on the other hand, the thermal and mechanical strength of the toner surface is likely to decline.

In light of these results, the present invention was arrived at based on experimental testing to determine the optimal crystal states of the crystalline polyester for achieving a mold release effect with the toner.

Specifically, the low electrical resistance of the crystalline polyester becomes an advantage and charge uniformity is improved on the toner surface if the crystalline polyester is present as crystals in the toner and the number-average major axis diameter (D1) (hereunder sometimes called Ls) of the crystals of the crystalline polyester dispersed up to a depth of 0.30 μm from the toner surface (in the toner surface layer) is 40 nm to 110 nm. Thus, the static adhesion of the toner to the carrier or developing roll is low even in low-humidity environments in which static adhesion is often a problem, and development efficiency is improved as a result. It is thought that this is because when a suitable number of low electrical resistance segments are present uniformly on the toner surface, charge moves more easily and spreads uniformly on the toner surface, and the number of projecting high charge density segments is reduced.

The number-average diameter (D1) of major axis lengths of the crystals of the crystalline polyester in the toner surface layer is preferably 50 nm to 100 nm.

Low-temperature fixability is improved if the number-average major axis diameter (D1) (hereunder sometimes called Li) of the crystals of the crystalline polyester dispersed deeper than 0.30 μm from the toner surface is 1.25 to 4.00 (preferably 1.5 to 3.7) times the number-average diameter (D1) of major axis lengths of the crystals of the crystalline polyester dispersed up to a depth of 0.30 μm from the toner surface. The shorter the major axes of the crystals of the crystalline polyester, the more rapidly they compatibilize with the amorphous polyester, and it is thought that since the melting endotherm is also more rapid, the surface layer is likely to melt preferentially during fixing, further improving low-temperature fixability because the toner particles are more likely to bind together via the surface layer even if the toner as a whole does not melt.

The major axis diameter D1 of the crystals of the crystalline polyester in the toner surface layer can be controlled by means of the cooling temperature (cooling speed) of the toner surface after heat treatment. The major axis diameter D1 of the crystals of the crystalline polyester in the toner interior can be controlled by controlling the cooling temperature (cooling speed) after melt kneading of the toner materials.

In the present invention, the number-average diameter (D1) of major axis lengths of the crystalline polyester resin dispersed deeper than 0.30 μm from the toner surface (in the toner interior) is preferably 60 nm to 300 nm (more preferably 100 nm to 250 nm). Hot offset of the toner during fixing is less likely if Li is within this range.

An observed aspect ratio of 6.0 to 30.0 of the crystalline polyester crystals in regions deeper than 0.30 μm from the toner surface is desirable for making the rise of charge more rapid under high humidity conditions, and for improving scatter and fogging in the developing apparatus. The aspect ratio is more preferably 8.0 to 20.0. This aspect ratio can be controlled by controlling the cooling temperature (cooling speed) after heat treatment of the toner surface, and the polarity difference between the crystalline polyester material and amorphous polyester material.

The aspect ratio of the crystals of the crystalline polyester in the toner surface layer is preferably 4.0 to 10.0.

In the number distribution of the major axis lengths of the crystalline polyester resin dispersed deeper than 0.30 μm from the toner surface (in the toner interior), a maximum at 80 nm to 200 nm (more preferably 100 nm to 160 nm) is desirable for improving hot offset resistance. In addition to the aspect ratio control methods described above, this maximum can be controlled by means of the temperature during toner kneading.

Moreover, in the number distribution of the major axis lengths of the crystalline polyester resin dispersed up to a depth of 0.30 μm from the toner surface (in the toner surface layer), a maximum of 50 nm to 100 nm (more preferably 70 nm to 90 nm) is preferred for reducing charge variation in low humidity environments, and improving fogging. In addition to the aspect ratio control methods described above, this maximum can be controlled by means of the heat treatment temperature of the toner surface.

A feature of the toner particles of the present invention is that they contain a crystalline polyester resin and an amorphous polyester resin.

(A/B Composition of Amorphous Polyester Resin)

The toner of the present invention preferably contains a polyester resin A with a low weight-average molecular weight consisting primarily of an aromatic diol, and a polyester resin B with a high weight-average molecular weight consisting primarily of an aromatic diol as binder resins. The weight-average molecular weight (Mw) of the polyester resin A is preferably 3000 to 10000. The weight-average molecular weight (Mw) of the polyester resin B is preferably 30000 to 300000.

"Consisting primarily" here signifies a percentage content of at least 50 mass %.

By using two polyesters with different weight-average molecular weights as binder resins, it is possible to improve the low-temperature fixability of the toner due to the effect of the polyester having a low weight-average molecular weight, while improving hot offset resistance due to the effect of the polyester having a high weight-average molecular weight.

The sum of the contents of the polyester resin A and polyester resin B in the toner is preferably 60 mass % to 99 mass %.

In the present invention, the content ratio of the polyester resin B relative to the polyester resin A (A/B) is from 60/40 to 80/20 by mass. A good balance of low-temperature fixability and hot offset resistance can be achieved if (A/B) is within this range.

Both the polyester resin A and polyester resin B preferably have polyvalent alcohol units and polyvalent carboxylic acid units. In the present invention, a polyvalent alcohol unit is a constituent derived from a polyvalent alcohol component used in condensation polymerization of the polyester. In the invention, a polyvalent carboxylic acid unit is a constituent derived from a polyvalent carboxylic acid or anhydride or lower (for example, $C_{1-8}$) alkyl ester thereof used in condensation polymerization of the polyester.

Preferably both the polyester resin A and the polyester resin B in the invention have polyvalent alcohol units and polyvalent carboxylic acid units, and polyvalent alcohol units derived from an aromatic diol constitute 90 mol % to 100 mol % of the total moles of the polyvalent alcohol units. Fogging can be controlled if the polyvalent alcohol units derived from an aromatic diol constitute at least 90 mol % of the total moles of the polyvalent alcohol units.

The fact that the polyvalent alcohol units of the polyester resin A have a structure derived from an aromatic diol in common with polyester resin B makes them more compatible and improves the dispersibility of the polyester A and polyester B.

Examples of aromatic diols include the bisphenol represented by Formula (1) and derivatives thereof.

(1)

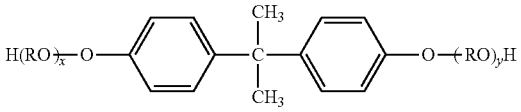

[in the formula, R is an ethylene or propylene group, each of x and y is 0 or an integer greater than 0, and the average of x+y is 0 to 10.]

It is desirable that the R values of the polyester resin A and polyester resin B in the Formula (1) be the same because this makes them more compatible during melt kneading. A bisphenol A propylene oxide adduct in which R is a propylene group in both cases and the average of x+y is 2 to 4 for example is desirable from the standpoint of charge stability.

(Amorphous Polyester Resin A)

In the polyester resin A of the present invention, preferably polyvalent alcohol units derived from an aromatic diol constitute 90 mol % to 100 mol % of the total moles of the polyvalent alcohol units. To ensure compatibility with the polyester B in the present invention, they preferably constitute at least 95 mol %, or more preferably 100 mol %.

The following polyvalent alcohol components may be used as components other than the aromatic diol for forming the polyvalent alcohol units of the polyester resin A: ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerin, 2-methylpropanetriol, 2-methyl-1,2,4-butanetriol, trimethylol ethane, trimethylol propane, 1,3,5-trihydroxymethyl benzene.

In the polyester resin A of the invention, polyvalent carboxylic acid units derived from an aromatic dicarboxylic acid or derivative thereof preferably constitute 90.0 mol % to 99.9 mol % of the total moles of the polyvalent carboxylic acid units.

If the percentage of polyvalent carboxylic units derived from an aromatic dicarboxylic acid or derivative thereof is within this range, compatibility with the polyester A is improved, and it is possible to control concentration fluctuation and fogging after long-term printing.

Examples of the aromatic dicarboxylic acid or derivative thereof include aromatic dicarboxylic acids such as phthalic acid, isophthalic acid and terephthalic acid, or their anhydrides.

Moreover, including polyvalent carboxylic acid units derived from an aliphatic dicarboxylic acid or derivative thereof in the amount of 0.1 mol % to 10.0 mol % of the total moles of the polyvalent carboxylic acid units is desirable for further improving the low-temperature fixability of the toner.

Examples of aliphatic dicarboxylic acids or their derivatives include alkyldicarboxylic acids such as succinic acid, adipic acid, sebacic acid and azelaic acid or their anhydrides; succinic acids substituted with $C_{6-18}$ alkyl or alkenyl groups, or their anhydrides; and unsaturated dicarboxylic acids such as fumaric acid, maleic acid and citraconic acid, or their anhydrides. Of these, succinic acid, adipic acid, fumaric acid and their acid anhydrides and lower alkyl esters can be used by preference.

Examples of polyvalent carboxylic acid units other than these include trivalent or tetravalent carboxylic acids such as trimellitic acid, pyromellitic acid, benzophenonetetracarboxylic acid and their anhydrides.

(Amorphous Polyester Resin B)

In addition to the above mentioned aromatic diols and oxyalkylene ethers of phenolic Novolac resins, the polyvalent alcohol components discussed above with reference to the amorphous resin A may be used as necessary as components of the polyvalent alcohol units making up the polyester resin B.

To improve the dispersibility of the resins with each other, the polyester resin B of the invention preferably contains polyvalent carboxylic acid units derived from an aliphatic dicarboxylic acid having a $C_{4-16}$ linear hydrocarbon as the principal chain with carboxyl groups at both ends, in the amount of 15 mol % to 50 mol % of the total moles of the polyvalent carboxylic acid units.

When the aliphatic dicarboxylic acid having a $C_{4-16}$ linear hydrocarbon as the principal chain with carboxyl groups at both ends reacts with the alcohol component, the principal chain acquires a partially flexible structure due to the linear hydrocarbon structure in the principal chain of the polyester. Therefore, in the toner melt kneading step when a polyester resin A with a low softening point is mixed with this polyester resin B having a high softening point originating in this flexible structure, the polyester resin B entwines with the principal chains of the polyester resin A, improving its dispersibility and also improving the dispersibility of the crystalline polyester resin.

Examples of the aliphatic dicarboxylic acid having a $C_{4-16}$ linear hydrocarbon as the principal chain with carboxyl groups at both ends include alkyldicarboxylic acids such as adipic acid, azelaic acid, sebacic acid, tetradecanedioic acid and octadecanedioic acid, or their anhydrides, and lower alkyl esters. Other examples include such compounds having branched structures with alkyl groups such as methyl, ethyl, octyl groups or alkylene groups in a part of the principal chain. The number of carbon atoms in the linear hydrocarbon is preferably 4 to 12, or more preferably 4 to 10.

Examples of the other polyvalent carboxylic acid units included in the polyester resin B include aromatic dicarboxylic acids such as phthalic acid, isophthalic acid and terephthalic acid, or their anhydrides; succinic acids substituted with $C_{6-18}$ alkyl or alkenyl groups, or their anhydrides; and unsaturated dicarboxylic acids such as fumaric acid, maleic acid and citraconic acid, or their anhydrides. Of these, a carboxylic acid or derivative thereof with an aromatic ring, such as terephthalic acid, isophthalic acid, trimellitic acid, pyromellitic acid, benzophenontetracarboxylic acid or their anhydrides, is preferred for ease of improving hot offset resistance.

(Other Binder Resin)

In addition to the polyester resin A and polyester resin B described above, the polymer D described below may be added as a binder resin in the toner of the invention in an amount that does not inhibit the effects of the invention with the aim of improving pigment dispersibility or increasing the charge stability or blocking resistance of the toner.

The polymer D has a structure comprising a hydrocarbon compound bound to a vinyl resin component. This polymer D is preferably a polymer comprising a polyolefin bound to a vinyl resin component, or a polymer having a vinyl resin component comprising a vinyl monomer bound to a polyolefin. It is thought that this polymer D increases the affinity between the polyester resin and the wax. This contributes to improving gloss uniformity by thoroughly controlling seepage of wax to the outermost toner surface at inorganic fine particle sites even when the temperature is high on the surface of the fixing unit.

The content of the polymer D per 100 mass parts of the amorphous polyester resin is preferably 2 to 10 mass parts, or more preferably 3 to 8 mass parts. Gloss uniformity can be further improved while maintaining the low-temperature fixability of the toner if the content of the polymer D is within this range.

The polyolefin in the polymer D is not particularly limited as long as it is a polymer or copolymer of an unsaturated hydrocarbon monomer having one double bond, and various polyolefins may be used. A polyethylene or polypropylene polyolefin is especially desirable.

The following are examples of vinyl monomers for use in the vinyl resin component of the polymer D:

styrene monomers such as styrenes and their derivatives, such as styrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene;

α-methylene aliphatic monocarboxylic acid esters containing amino groups, such as dimethylaminoethyl methacrylate and diethylaminoethyl methacrylate; vinyl monomers containing N atoms, such as acrylic acid and methacrylic acid derivatives such as acrylonitrile, methacrylonitrile and acrylamide;

unsaturated dibasic acids such as maleic acid, citraconic acid, itaconic acid, alkenylsuccinic acid, fumaric acid and mesaconic acid; unsaturated dibasic acid anhydrides, such as maleic anhydride, citraconic anhydride, itaconic anhydride and alkenylsuccinic anhydride; unsaturated dibasic acid half esters such as maleic methyl half ester, maleic ethyl half ester, maleic butyl half ester, citraconic methyl half ester, citraconic ethyl half ester, citraconic butyl half ester, itaconic methyl half ester, alkenylsuccinic methyl half ester, fumaric methyl half ester and mesaconic methyl half ester; unsaturated dibasic acid esters such as dimethylmaleic acid and dimethylfumaric acid; α,β-unsaturated acids such as acrylic acid, methacrylic acid, crotonic acid and cinnamic acid; α,β-unsaturated acid anhydrides such as crotonic acid anhydride and cinnamic acid anhydride, and anhydrides of these α,β-unsaturated acids with lower fatty acids; vinyl monomers containing carboxyl groups such as alkenylmalonic acid, alkenylglutaric acid and alkenyladipic acid, and their acid anhydrides and monoesters;

acrylic or methacrylic acid esters such as 2-hydroxyethyl acrylate, 2-hydroxyethyl methacrylate and 2-hydroxypropyl methacrylate; vinyl monomers containing hydroxyl groups, such as 4-(1-hydroxy-1-methylbutyl) styrene and 4-(1-hydroxy-1-methylhexyl)styrene;

acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; and methacrylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate, and other α-methylene aliphatic monocarboxylic acid esters.

For use in the present invention, the polymer D having a structure resulting from the reaction of a vinyl resin component and a hydrocarbon compound can be obtained by known methods, such as by a reaction between the vinyl monomers described above or a reaction between one polymer and the monomer raw material of the other polymer.

The structural units of the vinyl resin component preferably include styrene units, ester units and also acrylonitrile units or methacrylonitrile units.

In the present invention, another resin is preferably included in the toner as a dispersing agent so as to improve the dispersibility of the release agent and pigment, and also help to improve the dispersibility of the fine crystals of crystalline polyester on the surface.

Other resins that can be used as binder resins in the toner of the invention include the following resins for example: single polymers of styrene and substituted styrene, such as polystyrene, poly-p-chlorostyrene and polyvinyl toluene; styrene copolymers such as styrene-p-chlorostyrene copolymer, styrene-vinyl toluene copolomer, styrene-vinyl naphthaline copolymer, styrene-acrylic ester copolymer, styrene-methacrylic ester copolymer, styrene-α-methyl chloromethacrylate copolymer, styrene-acrylonitrile copolymer, styrene-vinyl methyl ether copolymer, styrene-vinyl ethyl ether copolymer, styrene-vinyl methyl ketone copolymer and styrene-acrylonitrile-indene copolymer; and polyvinyl chloride, phenolic resin, natural denatured phenolic resin, natural resin-denatured maleic acid resin, acrylic resin, methacrylic resin, polyvinyl acetate, silicone resin, polyester resin, polyurethane resin, polyamide resin, furan resin, epoxy resin, xylene resin, polyvinyl butyral, terpene resin, coumarone-indene resin, petroleum resin and the like.

(Release Agent (Wax))

The following are examples of the wax used in the toner of the invention: hydrocarbon waxes such as low-molecular-weight polyethylene, low-molecular-weight polypropylene, alkylene copolymer, microcrystalline wax, paraffin wax and Fischer-Tropsch wax; oxides of hydrocarbon waxes, such as polyethylene oxide wax, and block copolymers of these; waxes consisting primarily of fatty acid esters, such as carnauba wax; and waxes comprising partially or completely deoxidized fatty acid esters, such as deoxidized carnauba wax. Some other examples are: saturated linear fatty acids such as palmitic acid, stearic acid and montanoic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol and melissyl alcohol; polyvalent alcohols such as sorbitol; esters of fatty acids such as palmitic acid, stearic acid, behenic acid and montanoic acid with alcohols such as stearyl alcohol, aralkyl alcohol, behenyl alcohol, carnaubyl alcohol, ceryl alcohol and melissyl alcohol; fatty acid amides such as linoleic acid amides, oleic acid amides and lauric acid amides; saturated fatty acid bisamides such as methylene bis-stearamide, ethylene bis-capramide, ethylene bis-lauramide and hexamethylene bis-stearamide; unsaturated fatty acid amides such as ethylene bis-oleamide, hexamethylene bis-oleamide, N,N'-dioleyladipamide and N,N'-dioleylsebacamide; aromatic bisamides such as m-xylene bis-stearamide and N,N'-distearyl isophthalamide; aliphatic metal salts (generally called metal soaps) such as calcium stearate, calcium laurate, zinc stearate and magnesium stearate; waxes obtained by grafting aliphatic hydrocarbon waxes with vinyl monomers such as styrene or acrylic acid; partial esterification products of fatty acids and polyvalent alcohols, such as behenic acid monoglycerides; and hydroxyl-containing methyl ester compounds obtained by hydrogenating plant oils and fats.

Of these waxes, a hydrocarbon wax such as paraffin wax or Fischer-Tropsch wax or a fatty acid ester wax such as carnauba wax is desirable for improving low-temperature fixability and hot offset resistance. In the present invention, a hydrocarbon wax is more preferred for further improving hot offset resistance.

In the present invention, the wax is preferably used in the amount of 1 to 20 mass parts per 100 mass parts of the amorphous polyester resin.

Moreover, the peak temperature of the maximum endothermic peak of the wax is preferably 45° C. to 140° C. in a heat absorption curve obtained with a differential scanning calorimeter (DSC) during temperature rise. The peak temperature of the maximum endothermic peak of the wax is preferably within this range in order to achieve both storability and hot offset resistance of the toner.

Colorant

The following are examples of colorants that can be included in the toner.

Examples of black colorants include carbon black and blacks obtained by combining yellow, magenta and cyan colorants. A pigment may be used alone as a colorant, but considering the image quality of the full color images, it is desirable to improve color definition by combining a dye and a pigment.

The following are examples of pigments for magenta toners: C.I. pigment red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, 282; C.I. pigment violet 19; C.I. vat red 1, 2, 10, 13, 15, 23, 29, 35.

The following are examples of dyes for magenta toners: oil-soluble dyes such as C.I. solvent red 1, 3, 8, 23, 24, 25, 27, 30, 49, 81, 82, 83, 84, 100, 109, 121; C.I. disperse red 9; C.I. solvent violet 8, 13, 14, 21, 27; and C.I. disperse violet 1; and basic dyes such as C.I. basic red 1, 2, 9, 12, 13, 14, 15, 17, 18, 22, 23, 24, 27, 29, 32, 34, 35, 36, 37, 38, 39, 40; and C.I. basic violet 1, 3, 7, 10, 14, 15, 21, 25, 26, 27, 28.

The following are examples of cyan toner pigments: C.I. pigment blue 2, 3, 15:2, 15:3, 15:4, 16, 17; C.I. vat blue 6; C.I. acid blue 45; and copper phthalocyanine pigments substituted with 1 to 5 phthalimidomethyl groups in the phthalocyanine backbone.

C.I. solvent blue 70 is a cyan toner dye.

The following are examples of yellow toner pigments: C.I. pigment yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, 185, and C.I. vat yellow 1, 3, 20.

C.I. solvent yellow 162 is a yellow toner dye.

The colorant is preferably used in the amount of 0.1 to 30 mass parts per 100 mass parts of the amorphous polyester resin.

(Charge Control Agent)

A charge control agent may be included in the toner as necessary. A known agent may be used as the charge control agent in the toner, but an aromatic carboxylic acid metal compound that is colorless and capable of maintaining a rapid charging speed and a stable charge quantity of the toner is especially desirable.

Examples of negative charge control agents include salicylic acid metal compounds, naphthoic acid metal compounds, dicarboxylic acid metal compounds, polymeric compounds having sulfonic acid or caboxylic acid in the side chains, polymeric compounds having sulfonic acid salts or sulfonic acid esters in the side chains, polymeric compounds having carboxylic acid salts or carboxylic acid esters in the side chains, boron compounds, urea compounds, silicon compounds, and calixarene. Examples of positive charge control agents include quaternary ammonium salts, polymeric compounds having these quaternary ammonium salts in the side chains, guanidine compounds and imidazole compounds. The charge control agent may be added either internally or externally to the toner particles. The added amount of the charge control agent is preferably 0.2 to 10 mass parts per 100 mass parts of the amorphous polyester resin.

(Crystalline Polyester Resin)

The toner of the invention contains a crystalline polyester resin.

The crystalline polyester resin is preferably obtained by a polycondensation reaction of a monomer composition containing a $C_{2-22}$ aliphatic diol and a $C_{2-22}$ aliphatic dicarboxylic acid as principal components.

A crystalline resin is defined here as a resin that exhibits a clear endothermic peak (melting point) in a reversible specific heat change curve obtained by measuring changes in specific heat with a differential scanning calorimeter.

The $C_{2-22}$ (preferably $C_{4-12}$) aliphatic diol is not particularly limited, but is preferably a chain (more preferably linear) aliphatic diol. Examples include ethylene glycol, diethylene glycol, triethylene glycol, 1,2-propanediol, 1,3-propanediol, dipropylene glycol, 1,4-butanediol, 1,4-butadiene glycol, trimethylene glycol, tetramethylene glycol, pentamethylene glycol, hexamethylene glycol, octamethylene glycol, nonamethylene glycol, decamethylene glycol and neopentyl glycol. Of these, particularly desirable examples are linear aliphatic α,ω-diols such as ethylene glycol, diethylene glycol, 1,4-butanediol, and 1,6-hexanediol.

An alcohol selected from the $C_{2-22}$ aliphatic diols preferably constitutes at least 50 mass %, or more preferably at least 70 mass % of the alcohol component.

A polyvalent alcohol monomer other than the aforementioned aliphatic diol may also be used in the present invention. Of the polyvalent alcohol monomers, examples of bivalent alcohol monomers include aromatic alcohols such as polyoxyethylenated bisphenol A and polyoxypropylenated bisphenol A; and 1,4-cyclohexane dimethanol and the like. Moreover, of the polyvalent alcohol monomers, examples of trivalent or higher polyvalent alcohol monomers include aromatic alcohols such as 1,3,5-trihydroxymethyl benzene; and aliphatic alcohols such as pentaerythritol, dipentaerythritol, tripentaerythritol, 1,2,4-butanetriol, 1,2,5-pentanetriol, glycerin, 2-methylpropanetriol, 2-methyl-1,2,4-butanetriol, trimethylol ethane, trimethylol propane and the like.

Moreover, a monovalent alcohol may also be used in the invention to the extent that it does not detract from the properties of the crystalline polyester. Examples of this monovalent alcohol include monofunctional alcohols such as n-butanol, isobutanol, sec-butanol, n-hexanol, n-octanol, lauryl alcohol, 2-ethyl hexanol, decanol, cyclohexanol, benzyl alcohol, dodecyl alcohol and the like.

Meanwhile, the $C_{2-22}$ (preferably $C_{6-14}$) aliphatic dicarboxylic acid is not particularly limited, but is preferably a chain (more preferably linear) aliphatic dicarboxylic acid. Specific examples include oxalic acid, malonic acid, succinic acid, glutaric acid, adipic acid, pimelic acid, suberic acid, glutaconic acid, azelaic acid, sebacic acid, nonanedicarboxylic acid, decanedicarboxylic acid, undecanedicarboxylic acid, dodecanedicarboxylic acid, maleic acid, fumaric acid, mesaconic acid, citraconic acid and itaconic acid, as well as acid anhydrides or hydrogenated lower alkyl esters of these.

In the present invention, preferably a carboxylic acid selected from the $C_{2-22}$ aliphatic dicarboxylic acids constitutes at least 50 mass %, or more preferably at least 70 mass % of this carboxylic acid component.

A polyvalent carboxylic acid other than the aforementioned $C_{2-22}$ aliphatic dicarboxylic acid may also be used in the invention. Of the other polyvalent carboxylic monomers, examples of bivalent carboxylic acids include aromatic carboxylic acids such as isophthalic acid and terephthalic acid; aliphatic carboxylic acids such as n-dodecylsuccinic acid and n-dodecenylsuccinic acid; and alicyclic carboxylic acids such as cyclohexanedicarboxylic acid, as well as acid anhydrides or lower alkyl esters of these. Of the other carboxylic acid monomers, examples of trivalent or higher polyvalent carboxylic acids include aromatic carboxylic acids such as 1,2,4-benzenetricarboxylic acid (trimellitic acid), 2,5,7-naphthalenetricarboxylic acid, 1,2,4-naphthalenetricarboxylic acid and pyromellitic acid, and aliphatic carboxylic acids such as 1,2,4-butanetricarboxylic acid, 1,2,5-hexanetricarboxylic acid and 1,3-dicarboxyl-2-methyl-2-methylenecarboxypropane, as well as acid anhydrides or lower alkyl esters of these.

Moreover, a monovalent carboxylic acid may also be used in the invention to the extent that it does not detract from the properties of the crystalline polyester. Examples of monovalent carboxylic acids include monocarboxylic acids such as benzoic acid, naphthalenecarboxylic acid, salicilic acid, 4-methylbenzoic acid, 3-methylbenzoic acid, phenoxyacetic acid, biphenylcarboxylic acid, acetic acid, propionic acid, butyric acid, octanoic acid, decanoic acid, dodecanoic acid and stearic acid.

The crystalline polyester in the present invention can be manufactured by ordinary polyester synthesis methods. For example, the desired crystalline polyester can be obtained by subjecting the carboxylic acid monomer and alcohol monomer to an esterification reaction or transesterification reaction, followed by a polycondensation reaction performed by ordinary methods under reduced pressure or with introduced nitrogen gas.

This esterification or transesterification reaction can be performed as necessary using an ordinary esterification catalyst or transesterification catalyst such as sulfuric acid, titanium butoxide, dibutyl tin oxide, manganese acetate, magnesium acetate or the like.

The polycondensation reaction can be performed using an ordinary polymerization catalyst, such as titanium butoxide, dibutyl tin oxide, tin acetate, zinc acetate, tin disulfide, antimony trioxide or germanium dioxide. The polymerization temperature and amount of the catalyst are not particularly limited, and can be determined appropriately.

Methods that can be used in the esterification or transesterification reaction or polycondensation reaction include loading all the monomers at once in order to increase the strength of the resulting crystalline polyester, or reacting the bivalent monomers first and then adding and reacting the trivalent and higher monomers in order to reduce the low-molecular weight component.

In the present invention, the content of the crystalline polyester in the toner is preferably 2 mass % to 15 mass % in order to obtain good fixing performance and developability.

(Inorganic Fine Particles)

Inorganic fine particles may be used as necessary in the toner of the invention. The inorganic fine particles may be added internally to the toner particles, or mixed with the toner particles as an external additive. Inorganic fine particles such as silica, titanium oxide and aluminum oxide are preferred as external additives. The inorganic fine particles are preferably particles that have been hydrophobized with a hydrophobic agent such as a silane compound, silicone oil or a mixture of these.

Inorganic fine particles with a specific surface area of 50 $m^2/g$ to 400 $m^2/g$ are desirable for use as external additives for improving flowability, while inorganic fine particles with a specific surface area of 10 $m^2/g$ to 50 $m^2/g$ are desirable for stabilizing durability. Different inorganic fine particles with specific surface areas within these ranges may be combined in order to achieve both improved flowability and stable durability.

The external additive is preferably used in the amount of 0.1 to 10.0 mass parts per 100 mass parts of the toner particles. The toner particles and external additive may be mixed with a known mixing apparatus such as a Henschel mixer.

(Developer)

The toner of the invention can be used as a one-component developer, but a two-component developer obtained by mixing the toner with a magnetic carrier is preferred for improving dot reproducibility, and for obtaining stable images in the long term.

The magnetic carrier may be a commonly known carrier, such as a surface oxidized iron powder or unoxidized iron powder, or metal particles such as iron, lithium, calcium, magnesium, nickel, copper, zinc, cobalt, manganese, chromium and rare earth, or alloy or oxide particles of these, a magnetic body such as a ferrite, or a magnetic body-dispersed resin carrier (so-called resin carrier) containing a magnetic body and a binder resin supporting the magnetic body in a dispersed state.

Regarding the carrier mixing ratio when the toner of the invention is mixed with a magnetic carrier and used as a two-component developer, good results can normally be obtained if the toner concentration in the two-component developer is 2 mass % to 15 mass %, or preferably 4 mass % to 13 mass %.

(Manufacturing Method)

A preferred method of manufacturing the toner is a pulverization method in which the binder resins are melt kneaded together with a colorant and a wax as necessary, and the kneaded product is cooled, pulverized and classified.

The toner manufacturing procedures using the pulverization method are explained below.

In the raw material mixing step, the constituent materials of the toner particles, such as the binder resins and other components such as a colorant, wax and charge control agent as needed, are measured in specified amounts, blended and mixed. Examples of mixing apparatuses include the double cone mixer, V-shaped mixer, drum mixer, super mixer, Henschel mixer, Nauta mixer and Mechano-Hybrid (Nippon Coke & Engineering) and the like.

Next, the mixed materials are melt kneaded to disperse the wax, crystalline polyester and the like in the binder resin. The kneading and discharge temperature is preferably 100° C. to 170° C. A batch kneader such as a pressure kneader or Banbury mixer, or a continuous kneader may be used in the melt kneading step, but single screw or twin screw extruders are chiefly used because they are advantageous for continuous production. Examples include a KTK twin screw extruder available from Kobe Steel, Ltd., a TEM twin screw extruder available from Toshiba Machine Co., Ltd., a PCM kneader available from Ikegai Ironworks Corp., a twin screw extruder available from K.C.K. Co., a co-kneader available from Buss Corp., and a Kneadex available from Nippon Coke & Engineering. The resin composition obtained by melt kneading can then be rolled with a double roll or the like, and cooled with water or the like in a cooling step. The cooling speed is preferably 1 to 50° C./min.

Next, the cooled resin composition is pulverized to the desired particle size in a pulverization step. The pulverization step may comprise coarse pulverization with a crushing apparatus such as a crusher, hammer mill and feather mill, followed by further fine pulverization with a fine pulverizing apparatus such as a Kryptron pulverizer (Kawasaki Heavy Industries Ltd.), a Super Rotor (Nisshin Engineering Inc.), a Turbo Mill (Turbo Kogyo Co., Ltd.), or a fine pulverizing apparatus by an air jet system for example.

This is then classified as necessary with a sieving machine or classifier such as an Elbow Jet (Nittetsu Mining Co., Ltd.) using inertial classification, a Turboplex (Hosokawa Micron Corporation) using centrifugal classification, a TSP separator (Hosokawa Micron Corporation), a Faculty (Hosokawa Micron Corporation) or the like.

Next, external additives that have been selected as necessary such as inorganic fine powder or resin particles may be added and mixed (external addition). For example, an external additive may be added to confer flowability and obtain pre-heat-treatment toner particles.

Mixing can be performed with a mixing apparatus having a rotating member equipped with an agitator and also having a main casing separated by a gap from the agitator. Examples of such mixing apparatuses include a Henschel Mixer (Mitsui Mining Co., Ltd.), Super Mixer (Kawata Mfg Co., Ltd.), Ribocone (Okawara Mfg. Co., Ltd.), Nauta Mixer, Turbulizer, Cyclomix (Hosokawa Micron Corporation), Spiral Pin Mixer (Pacific Machinery & Engineering Co., Ltd.), Lodige Mixer (Matsubo Corporation) and Nobilta (Hosokawa Micron Corporation). A Henschel Mixer (Mitsui Mining Co., Ltd.) is particularly desirable for achieving uniform mixing and breaking up silica aggregates.

The machine conditions for mixing include treated amount, agitator shaft rotations, agitation time, agitator blade shape, tank temperature and the like, which can be selected appropriately considering the properties of the toner particles and the types of additives, without any particular limitations, in order to achieve the desired toner properties.

It is important in the present invention that a layer containing dispersed crystalline polyester with a very fine particle size be formed in the surface layer of the toner particles obtained by the manufacturing method described above or the like.

The method is not particularly limited, but a method of first including crystalline polyester crystals of a specific size when forming the toner particles, and then surface modifying the toner particles to thereby form a resin layer in which the crystalline polyester is present in the form of very fine crystals, is preferred for achieving strong adhesiveness of the binder resin in the toner surface layer and interior and for obtaining good storage stability of the toner.

The surface modification method may be a method of first using light or heat to compatibilize the crystals of the crystalline resin with the amorphous resin only in the toner surface layer, and then re-precipitating the crystals.

Surface modification with heat is preferred from the standpoint of productivity and freedom of material selection.

A toner surface modification method using heat is described here.

Figure 4:
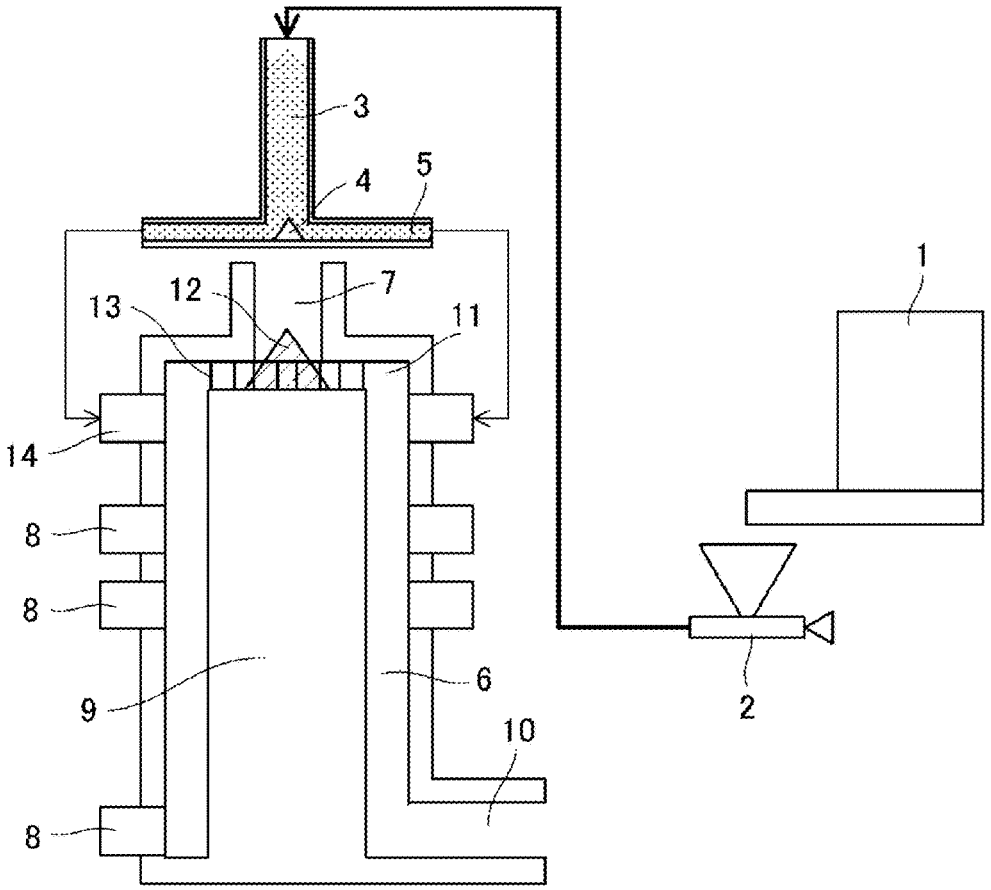
FIG. 4 shows a toner manufacturing apparatus in cross-section.

In the present invention, surface treatment with a hot air current is performed as the surface modification step using the surface treatment apparatus shown in FIG. 4 for example.

A mixture is volumetrically supplied by a raw material volumetric feed means 1, and conducted by a compressed gas regulated by a compressed gas regulation means 2 to introduction pipe 3, which is disposed on the same vertical line as the raw material feed means. After passing through the introduction pipe, the mixture is uniformly dispersed by conical projecting member 4 provided in the center of the raw material feed means. It is then conducted to feed pipes 5 extending radially in 8 directions, and conducted to treatment chamber 6 for heat treatment.

The flow of the mixture supplied to the treatment chamber is regulated by a regulation means 9 for regulating the flow of the mixture provided in the treatment chamber. Therefore, the mixture supplied to the treatment chamber is heat treated while circulating in the treatment chamber, and then cooled.

The heat for heat treating the supplied mixture is supplied by a hot air supply means 7 and distributed by a distribution member 12, and a circulation member 13 for circulating the hot air current introduces the hot air current into the treatment chamber while circulating it spirally. In this configuration, the circulation member 13 for circulating the hot air current may have multiple blades so that the circulation of the hot air current is controlled by means of the number and angles of the blades. Regarding the hot air current supplied inside the treatment chamber, the temperature at the outlet of the hot air supply means 7 is preferably at or above the melting point of the crystals of the crystalline polyester, and 20° C. to 70° C. higher than the softening point Tm of the toner particles. For example, it is preferably 120° C. to 170° C. If the temperature at the outlet of the hot air supply means is within this range, it is possible to prevent melt adhesion and coalescing of the toner particles due to overheating of the mixture while performing surface modification treatment uniformly and only on the surfaces of the toner particles. The hot air current is supplied from the hot air supply means outlet 11. The flow rate of the hot air current is preferably 2 to 20 $m^3$/min.

The heat treated toner particles are then cooled by a cool air current supplied by cool air supply means 8, with the temperature of the air supplied by the cool air supply means 8 being preferably −40° C. to 20° C. If the temperature of the cool air current is within this range, the heat-treated toner particles can be cooled efficiently, and melt adhesion and coalescing of the heat-treated toner particles can be prevented as crystalline polyester that has been blended in the surface layer of the toner particles is precipitated as very fine crystals. The absolute moisture content of the cool air current is preferably 0.5 g/$m^3$ to 15.0 g/$m^3$. The cool air current volume is preferably 1 to 30 $m^3$/min.

Next, the cooled heat-treated toner particles are collected by collection means 10 at the bottom of the treatment chamber. A blower (not shown) is provided at the end of the collection means to transport the particles by suction.

Powder particle feeding port 14 is provided in such a way that the circulating direction of the supplied mixture is the same as the circulating direction of the hot air current, and collection means 10 of the surface treatment unit is provided on the outer circumference of the treatment chamber so as to maintain the circulating direction of the circulating powder particles. Moreover, the device is configured so that the cool air current supplied by the cool air supply means 8 is supplied horizontally and tangentially from the outer circumference of the apparatus to the inner periphery of the treatment chamber. The circulating direction of the pre-heat-treatment toner particles supplied from the powder feeding port, the circulating direction of the cool air current supplied from the cool air supply means and the circulating direction of the hot air current supplied from the hot air supply means are all the same direction. This means that no turbulence occurs within the treatment chamber, reinforcing the circulating flow within the device so that the pre-heat-treatment toner particles are subject to strong centrifugal force, thus further improving the dispersibility of the pre-heat-treatment toner particles and resulting in heat-treated toner particles containing few coalesced particles.

Moreover, externally adding and mixing fine particles in advance in the toner particles to confer flowability before introducing the toner into the heat-treatment apparatus also serves to improve the dispersibility of the toner in the apparatus, reducing coalesced particles and controlling variation in surface modification among the particles.

The selected external additives such as inorganic fine powder or resin particles can then be added and mixed (external addition) as necessary to confer flowability or improve charge stability for example and produce the toner. Mixing can be performed with a mixing apparatus having a rotating member equipped with an agitator and also having a main casing separated by a gap from the agitator.

Examples of such mixing apparatuses include the Henschel Mixer (Mitsui Mining Co., Ltd.), Super Mixer (Kawata Mfg Co., Ltd.), Ribocone (Okawara Mfg. Co., Ltd.), Nauta Mixer, Turbulizer, Cyclomix (Hosokawa Micron Corporation), Spiral Pin Mixer (Pacific Machinery & Engineering Co., Ltd.), Lodige Mixer (Matsubo Corporation) and Nobilta (Hosokawa Micron Corporation). A Henschel Mixer (Mitsui Mining Co., Ltd.) is particularly desirable for achieving uniform mixing and breaking up silica aggregates.

The machine conditions for mixing include treated amount, agitator shaft rotations, agitation time, agitator blade shape, tank temperature and the like, which can be selected appropriately considering the properties of the toner particles and the types of additives, without any particular limitations, in order to achieve the desired toner properties.

A sieving machine or the like may also be used as necessary in cases in which coarse aggregates of an additive for example are freely present in the resulting toner.

The methods for measuring the various physical properties of the toner and raw materials are explained below.

(Evaluation of Crystal State of Crystalline Polyester by TEM)

The toner was observed in cross-section by transmission electron microscopy (TEM), and the crystalline polyester domains were evaluated as follows.

A toner cross-section was dyed with ruthenium to obtain a clear contrast of the crystalline polyester resin. The crystalline polyester resin dyes more weakly than the organic components constituting the toner interior. It is thought that this is because penetration of the dye material in the crystalline polyester resin is weaker than in the organic component of the toner interior due to differences in density and the like. Because the strength or weakness of the dye reflects differences in the amount of ruthenium atoms, the strongly dyed parts indicate areas with more of these atoms, and appear black in the image because the electron beam does not pass through them, while the weakly dyed parts appear white because the electron beam passes through them easily.

The ruthenium dye that fails to penetrate inside the crystalline polyester is likely to remain at the boundaries between the crystalline polyester and the amorphous polyester, and when the crystals are needle-shaped the crystalline polyester appears black as a result.

Using an Osmium Plasma Coater (Filgen, Inc., OPC80T), the toner was provided with an Os film (5 nm) and a naphthalene film (20 nm) as protective films, and embedded in D800 photocurable resin (JEOL), after which a toner cross-section 60 nm (or 70 nm) thick was prepared with an ultrasonic Ultramicrotome (Leica Microsystems, UC7) at a cutting speed of 1 mm/s.

The resulting cross-section was dyed for 15 minutes in a $RuO_4$ gas 500 Pa atmosphere with a vacuum electron staining apparatus (Filgen, Inc., VSC4R1H), and subjected to STEM observation using a TEM (JEOL, JEM2800).

The STEM probe size was 1 nm, and the image size was 1024×1024 pixels.

The resulting image was binarized (threshold 120/255 stages) with image processing software (Media Cybernetics Inc. "Image-Pro Plus").

The resulting cross-sectional image before binarization is shown in FIG. 1. As shown in FIG. 1, the crystal domains of the crystalline polyester can be confirmed as black needle shapes, and by binarizing the resulting image, it is possible to extract the crystalline domains and measure their size. In a cross-sectional observation of 20 randomly selected toner particles of the present invention, all of the major axis and minor axis lengths of the measurable crystal domains of the crystalline polyester are measured. The number average of the lengths of the crystalline polyester crystals (number-average diameter (D1)) in the region up to a depth of 0.30 μm from the toner surface (area of arrow a surrounded by broken lines in FIG. 1) and the number average of the lengths of the crystalline polyester crystals (number-average diameter (D1)) in the region inward from the region of arrow a were determined. Crystals straddling the boundary (present at the boundary) at 0.30 μm from the toner surface are not measured.

Figure 2:
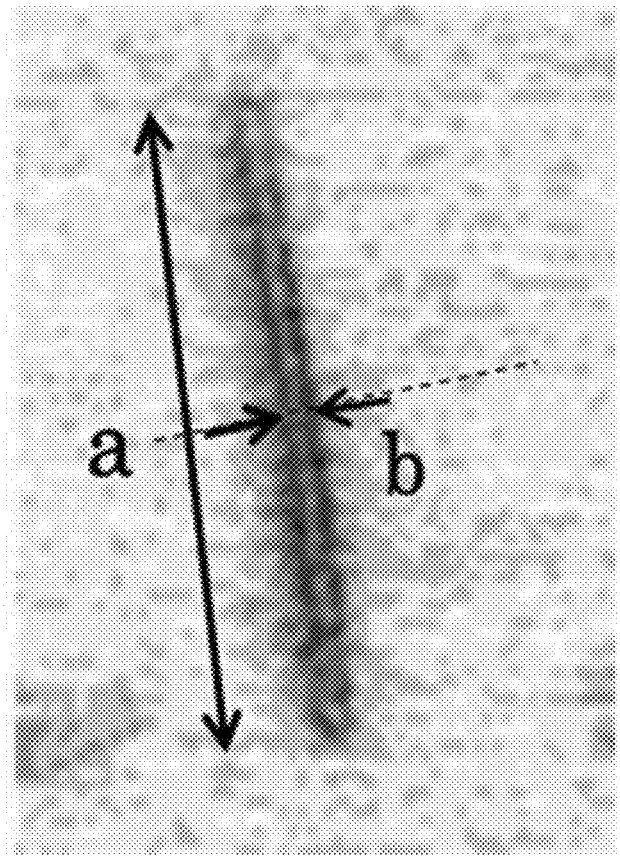
FIG. 2 illustrates the major axis length and minor axis length of the crystalline polyester in a toner cross-section.

As shown in FIG. 2, the major axis length of a crystal domain of the crystalline polyester is the maximum distance (a in FIG. 2) in the crystal domain in a cross-sectional image, while the minor axis length is the minimum distance at the midpoint of the major crystal axis (b in FIG. 2).

The aspect ratio of the crystalline polyester resin dispersed deeper than 0.30 μm from the toner surface is calculated from the major and minor axis lengths of the crystal domains of the crystalline polyester as measured above, using the arithmetic mean values of each.

"Needle-shaped" in the present invention indicates a long, thin and very straight shape, and means that in a crystal having a minor axis length of 25 nm or less and an aspect ratio (major axis/minor axis) of 3 or more, when a straight line is drawn between the centers in the minor axis direction at both ends of the crystal in the major axis direction, the deviation in the crystal outline from this straight line is within 100% of the minor axis length of the crystal.

(Number Distribution and Maximum Values of Major Axis Lengths of Crystalline Polyester Resin)

Figure 3:
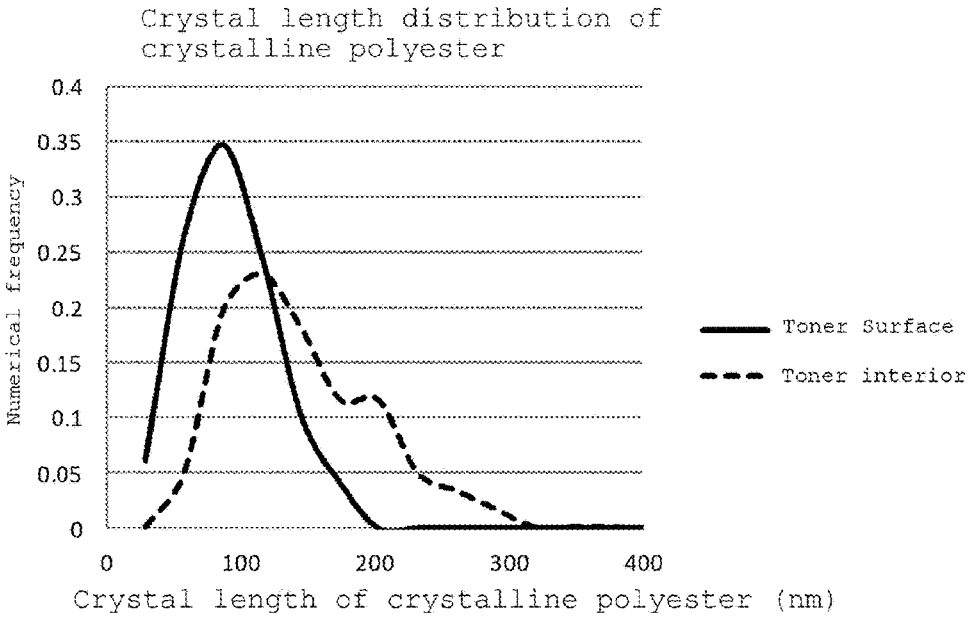
FIG. 3 is a distribution graph of the crystal lengths of the crystalline polyester in a toner cross-section.

A number distribution graph of the major axis lengths of the crystalline polyester resin is prepared and the maximum values were calculated as follows. Using the data for all the measured major axis lengths of the crystalline polyester in the region up to a depth of 0.30 μm from the toner surface and the region deeper than 0.30 μm from the toner surface in a toner cross-section of 20 randomly selected toner particles, a number distribution is prepared with the major axis lengths classified in 5 nm increments (more than 0 nm to 5 nm, more than 5 nm to 10 nm and so forth). The major axis length with the greatest numerical frequency in the number distribution is then determined, and this value is given as the maximum value for major axis length. An example of a number distribution graph is shown in FIG. 3.

(Method for Measuring Weight-Average Molecular Weight of Resin)

The molecular weight distribution of the THF soluble matter of the resin is measured as follows by gel permeation chromatography (GPC).

First, the toner is dissolved in tetrahydrofuran (THF) over 24 hours at room temperature. The resulting solution is then filtered with a solvent-resistant membrane filter ("Pretreatment Disk", Tosoh Corporation) with a pore diameter of 0.2 μm to obtain a sample solution. The sample solution is adjusted to a concentration of about 0.8 mass % of the THF-soluble components. Measurement is then performed under the following conditions using this sample solution.

Apparatus: HLC8120 GPC (detector: RI) (Tosoh Corporation)

Columns: Series of 7: Shodex KF-801, 802, 803, 804, 805, 806, 807 (Showa Denko K.K.)

Eluent: Tetrahydrofuran (THF)

Flow rate: 1.0 ml/min.

Oven temperature: 40.0° C.

Injected amount of sample: 0.10 ml

A molecular weight calibration curve prepared using standard polystyrene resin (for example, TSK Standard Polystyrene™ F-850, F-450, F-288, F-128, F-80, F-40, F-20, F-10, F-4, F-2, F-1, A-5000, A-2500, A-1000, A-500, Tosoh Corporation) is used for calculating the molecular weight of the sample.

(Method of Measuring Weight-Average Particle Diameter (D4) of Toner Particles)

Using a Multisizer® 3 Coulter Counter precise particle size distribution analyzer (Beckman Coulter, Inc.) based on the pore electrical resistance method with a 100 μm aperture tube together with the accessory dedicated Beckman Coulter Multisizer 3 Version 3.51 software (Beckman Coulter, Inc.) for setting measurement conditions and analyzing measurement data, the particles are measured with 25,000 effective measurement channels, and the measurement data are analyzed to calculate the weight-average particle diameter (D4) of the toner particles.

The aqueous electrolyte solution used in measurement may be a solution of special grade sodium chloride dissolved in ion exchange water to a concentration of about 1 mass %, such as ISOTON II (Beckman Coulter, Inc.) for example.

The dedicated software settings are performed as follows prior to measurement and analysis.

On the "Standard measurement method (SOM) changes" screen of the dedicated software, the total count number in control mode is set to 50000 particles, the number of measurements to 1, and the Kd value to a value obtained with "standard particles 10.0 μm" (Beckman Coulter, Inc.). The threshold noise level is set automatically by pushing the "Threshold/Noise Level measurement button". The current is set to 1600 μA, the gain to 2, and the electrolyte solution to ISOTON II, and a check is entered for aperture tube flush after measurement.

On the "Conversion settings from pulse to particle diameter" screen of the dedicated software, the bin interval is set to the logarithmic particle diameter, the particle diameter bins to 256, and the particle diameter range to 2 μm to 60 μm.

The specific measurement methods are as follows.

(1) About 200 ml of the aqueous electrolyte solution is added to a specialized 250 ml round-bottomed beaker for the Multisizer 3, the beaker is set on the sample stand, and stirring is performed with a stirrer rod counter-clockwise at a rate of 24 rotations/second. Contamination and bubbles in the aperture tube are then removed by the "Aperture flush" function of the dedicated software.

(2) 30 ml of the same aqueous electrolyte solution is placed in a glass 100 ml flat-bottomed beaker, and about 0.3 ml of a dilution of "Contaminon N" (a 10% by mass aqueous solution of a neutral detergent for washing precision measuring devices, formed from a nonionic surfactant, an anionic surfactant, and an organic builder and having a pH of 7, manufactured by Wako Pure Chemical Industries, Ltd.) diluted 3× by mass with ion exchange water is added.

(3) A specific amount of ion exchange water is placed in the water tank of an ultrasonic disperser (Ultrasonic Dispersion System Tetora 150, Nikkaki Bios Co., Ltd.) with an electrical output of 120 N equipped with two built-in oscillators having an oscillating frequency of 50 kHz with their phases shifted by 180° from each other, and about 2 ml of the Contaminon N is added to this water tank.

(4) The beaker of (2) above is set in the beaker-fixing hole of the ultrasonic disperser, and the ultrasonic disperser is operated. The height position of the beaker is adjusted so as to maximize the resonant condition of the liquid surface of the aqueous electrolyte solution in the beaker.

(5) As the aqueous electrolyte solution in the beaker of (4) is exposed to ultrasound, about 10 mg of toner is added bit by bit to the aqueous electrolyte solution, and dispersed. Ultrasound dispersion is then continued for a further 60 seconds. During ultrasound dispersion, the water temperature in the tank is adjusted appropriately to 10° C. to 40° C.

(6) The aqueous electrolyte solution of (5) with the toner dispersed therein is dripped with a pipette into the round-bottomed beaker of (1) set on the sample stand, and adjusted to a measurement concentration of about 5%. Measurement is then performed until the number of measured particles reaches 50000.

(7) The measurement data is analyzed with the dedicated software attached to the apparatus, and the weight-average particle diameter (D4) is calculated. The "Average diameter" on the "Analysis/volume statistical value (arithmetic mean)" screen when Graph/volume % is set in the dedicated software corresponds to the weight-average particle diameter (D4).

(Method for Measuring Softening Point of Resin)

The softening point of the resin was measured with a Flow Tester CFT-500D capillary rheometer (Shimadzu Corporation), a flow characteristics evaluating apparatus using a constant-load extrusion system, in accordance with the attached manual. With this apparatus, the temperature of a measurement sample packed in a cylinder is raised to melt the sample as a constant load is applied with a piston from above the measurement sample, the melted measurement sample is extruded from a die at the bottom of the cylinder, and a flow curve is obtained showing the relationship between the temperature and the descent of the piston.

In the present invention, the softening point is the melting temperature by the ½ method as described in the accessory manual of the Flow Tester CFT-500D flow characteristics evaluating apparatus. The melting temperature by the ½ method is calculated as follows. The difference between the descent of the piston Smax upon completion of outflow and the descent of the piston Smin at the beginning of outflow is calculated and divided by 2 to give X (X=(Smax−Smin)/2). The temperature at which the descent of the piston reaches X on the flow curve is then given as the melting temperature by the 1/2 method.

For the measurement sample, about 1.0 g of resin is compression molded for about 60 seconds at about 10 MPa with a tablet press (for example, NT-100H, NPA System Co., Ltd.) in a 25° C. environment to obtain a cylinder 8 mm in diameter.

The CFT-500D measurement conditions are as follows.

| | |
|---|---|
| Test mode: | Temperature increase method |
| Initiation temperature: | 50° C. |
| Saturated temperature: | 200° C. |
| Measurement interval: | 1° C. |
| Ramp rate: | 4.0° C./min. |
| Piston cross-section: | 1.000 $cm^2$ |
| Test load (piston load): | 10.0 kgf (0.9807 MPa) |
| Preheating time: | 300 seconds |
| Die hole diameter: | 1.0 mm |
| Die length: | 1.0 mm |

EXAMPLES

Amorphous Polyester Resin A1 Manufacturing Example

Polyoxypropylene(2.2)-2,2-bis(4-hydroxyphenyl)propane: 71.9 mass parts (0.20 moles; 100.0 mol % of total moles of polyvalent alcohol)

Terephthalic acid: 26.8 mass parts (0.16 moles; 96.0 mol % of total moles of polyvalent carboxylic acid)

Titanium tetrabutoxide: 0.5 mass parts

These materials were measured into a reaction vessel equipped with a cooling tube, an agitator, a nitrogen introduction tube and a thermocouple. Nitrogen gas was then substituted inside the flask, the temperature was raised gradually with agitation, and a reaction was performed for 4 hours at 200° C. with agitation.

The pressure inside the reaction vessel was lowered to 8.3 kPa, maintained for one hour, and then returned to atmospheric pressure (first reaction step).

Anhydrous trimellitic acid: 1.3 mass parts (0.01 moles; 4.0 mol % of total moles of polyvalent carboxylic acid)

This material was then added, the pressure inside the reaction vessel was reduced to 8.3 kPa, and a reaction was performed for one hour with the temperature maintained at 180° C. (second reaction step) to obtain a polyester resin A1 with a weight-average molecular weight (Mw) of 5000.

Amorphous Polyester Resin A2 Manufacturing Example

Polyoxyethylene(2.2)-2,2-bis(4-hydroxyphenyl)propane: 71.9 mass parts (0.20 moles; 100.0 mol % of total moles of polyvalent alcohol)

Terephthalic acid: 26.8 mass parts (0.16 moles; 96.0 mol % of total moles of polyvalent carboxylic acid)

Titanium tetrabutoxide: 0.5 mass parts

These materials were measured into a reaction vessel equipped with a cooling tube, an agitator, a nitrogen introduction tube and a thermocouple. Nitrogen gas was then substituted inside the flask, the temperature was raised gradually with agitation, and a reaction was performed for 4 hours at 200° C. with agitation.

The pressure inside the reaction vessel was lowered to 8.3 kPa, maintained for one hour, and then returned to atmospheric pressure (first reaction step).

Anhydrous trimellitic acid: 1.3 mass parts (0.01 moles; 4.0 mol % of total moles of polyvalent carboxylic acid)

This material was then added, the pressure inside the reaction vessel was reduced to 8.3 kPa, and a reaction was performed for one hour with the temperature maintained at 180° C. (second reaction step) to obtain a polyester resin A2 with a weight-average molecular weight (Mw) of 4800.

Amorphous Polyester Resin A3 Manufacturing Example

Polyoxybutylene(2.2)-2,2-bis(4-hydroxyphenyl)propane: 71.9 mass parts (0.20 moles; 100.0 mol % of total moles of polyvalent alcohol)

Terephthalic acid: 26.8 mass parts (0.16 moles; 96.0 mol % of total moles of polyvalent carboxylic acid)

Titanium tetrabutoxide: 0.5 mass parts

These materials were measured into a reaction vessel equipped with a cooling tube, an agitator, a nitrogen introduction tube and a thermocouple. Nitrogen gas was substituted inside the flask, the temperature was raised gradually with agitation, and a reaction was performed for 4 hours at 200° C. with agitation.

The pressure inside the reaction vessel was lowered to 8.3 kPa, maintained for one hour, and then returned to atmospheric pressure (first reaction step).

Anhydrous trimellitic acid: 1.3 mass parts (0.01 moles; 4.0 mol % of total moles of polyvalent carboxylic acid)

This material was then added, the pressure inside the reaction vessel was reduced to 8.3 kPa, and a reaction was performed for one hour with the temperature maintained at 180° C. (second reaction step) to obtain a polyester resin A3 with a weight-average molecular weight (Mw) of 5300.

Amorphous Polyester Resin A4 Manufacturing Example 2,2-bis(4-hydroxyphenyl)propane: 71.9 mass parts (0.20 moles; 100.0 mol % of total moles of polyvalent alcohol)

Terephthalic acid: 26.8 mass parts (0.16 moles; 96.0 mol % of total moles of polyvalent carboxylic acid)

Titanium tetrabutoxide: 0.5 mass parts

These materials were measured into a reaction tank equipped with a cooling tube, an agitator, a nitrogen introduction tube and a thermocouple. Nitrogen gas was substituted inside the flask, the temperature was raised gradually with agitation, and a reaction was performed for 4 hours at 200° C. with agitation.

The pressure inside the reaction tank was lowered to 8.3 kPa, maintained for one hour, and then returned to atmospheric pressure (first reaction step).

Anhydrous trimellitic acid: 1.3 mass parts (0.01 moles; 4.0 mol % of total moles of polyvalent carboxylic acid)

This material was then added, the pressure inside the reaction tank was reduced to 8.3 kPa, and a reaction was performed for one hour with the temperature maintained at 180° C. (second reaction step) to obtain a polyester resin A4 with a weight-average molecular weight (Mw) of 4900.

Amorphous Polyester Resin A5 Manufacturing Example 100 g of a bisphenol A propylene oxide adduct as an manufacturing alcohol component and 100 g of terephthalic acid as an acid component of the polyester A were prepared, and reacted under conditions of 200° C., 6 hours in a flask equipped with a nitrogen introduction tube and a dewatering tube. The atmospheric pressure was changed to 8 kPa, the mixture was reacted for an additional hour, and the resulting reaction product was taken as polyester resin A5. The measured value of the glass transition temperature Tg (° C.) of the polyester resin A5 was 58° C.

Amorphous Polyester Resin B1 Manufacturing Example

Polyoxypropylene(2.2)-2,2-bis(4-hydroxyphenyl)propane: 71.8 mass parts (0.20 moles; 100.0 mol % of total moles of polyvalent alcohol)

Terephthalic acid: 15.0 mass parts (0.09 moles; 55.0 mol % of total moles of polyvalent carboxylic acid)

Adipic acid: 6.0 mass parts (0.04 moles; 25.0 mol % of total moles of polyvalent carboxylic acid)

Titanium tetrabutoxide: 0.5 mass parts

These materials were measured into a reaction vessel equipped with a cooling tube, an agitator, a nitrogen introduction tube and a thermocouple. Nitrogen gas was substituted inside the flask, the temperature was raised gradually with agitation, and a reaction was performed for 2 hours at 200° C. with agitation.

The pressure inside the reaction vessel was lowered to 8.3 kPa, maintained for one hour, and then returned to atmospheric pressure (first reaction step).

Anhydrous trimellitic acid: 6.4 mass parts (0.03 moles; 20.0 mol % of total moles of polyvalent carboxylic acid)

This material was then added, the pressure inside the reaction vessel was reduced to 8.3 kPa, and a reaction was performed for 15 hours with the temperature maintained at 160° C. (second reaction step) to obtain a polyester resin B1 with a weight-average molecular weight (Mw) of 100000.

Amorphous Polyester Resin B2 Manufacturing Example

Polyoxyethylene(2.2)-2,2-bis(4-hydroxyphenyl)propane: 71.8 mass parts (0.20 moles; 100.0 mol % of total moles of polyvalent alcohol)

Terephthalic acid: 15.0 mass parts (0.09 moles; 55.0 mol % of total moles of polyvalent carboxylic acid)

Adipic acid: 6.0 mass parts (0.04 moles; 25.0 mol % of total moles of polyvalent carboxylic acid)

Titanium tetrabutoxide: 0.5 mass parts

These materials were measured into a reaction vessel equipped with a cooling tube, an agitator, a nitrogen introduction tube and a thermocouple. Nitrogen gas was substituted inside the flask, the temperature was raised gradually with agitation, and a reaction was performed for 2 hours at 200° C. with agitation.

The pressure inside the reaction tank was lowered to 8.3 kPa, maintained for one hour, and then returned to atmospheric pressure (first reaction step).

Anhydrous trimellitic acid: 6.4 mass parts (0.03 moles; 20.0 mol % of total moles of polyvalent carboxylic acid)

This material was then added, the pressure inside the reaction tank was reduced to 8.3 kPa, and a reaction was performed for 15 hours with the temperature maintained at 160° C. (second reaction step) to obtain a polyester resin B2 with a weight-average molecular weight (Mw) of 110000.

Amorphous Polyester Resin B3 Manufacturing Example

Polyoxybutylene(2.2)-2,2-bis(4-hydroxyphenyl)propane: 71.8 mass parts (0.20 moles; 100.0 mol % of total moles of polyvalent alcohol)

Terephthalic acid: 15.0 mass parts (0.09 moles; 55.0 mol % of total moles of polyvalent carboxylic acid)

Adipic acid: 6.0 mass parts (0.04 moles; 25.0 mol % of total moles of polyvalent carboxylic acid)

Titanium tetrabutoxide: 0.5 mass parts

These materials were measured into a reaction tank equipped with a cooling tube, an agitator, a nitrogen introduction tube and a thermocouple. Nitrogen gas was substituted inside the flask, the temperature was raised gradually with agitation, and a reaction was performed for 2 hours at 200° C. with agitation.

The pressure inside the reaction tank was lowered to 8.3 kPa, maintained for one hour, and then returned to atmospheric pressure (first reaction step).

Anhydrous trimellitic acid: 6.4 mass parts (0.03 moles; 20.0 mol % of total moles of polyvalent carboxylic acid)

This material was then added, the pressure inside the reaction tank was reduced to 8.3 kPa, and a reaction was performed for 15 hours with the temperature maintained at 160° C. (second reaction step) to obtain a polyester resin B3 with a weight-average molecular weight (Mw) of 120000.

Amorphous Polyester Resin B4 Manufacturing Example 2,2-bis(4-hydroxyphenyl)propane: 71.8 mass parts (0.20 moles; 100.0 mol % of total moles of polyvalent alcohol)

Terephthalic acid: 15.0 mass parts (0.09 moles; 55.0 mol % of total moles of polyvalent carboxylic acid)

Adipic acid: 6.0 mass parts (0.04 moles; 25.0 mol % of total moles of polyvalent carboxylic acid)

Titanium tetrabutoxide: 0.5 mass parts

These materials were measured into a reaction tank equipped with a cooling tube, an agitator, a nitrogen introduction tube and a thermocouple. Nitrogen gas was substituted inside the flask, the temperature was raised gradually with agitation, and a reaction was performed for 2 hours at 200° C. with agitation.

The pressure inside the reaction tank was lowered to 8.3 kPa, maintained for one hour, and then returned to atmospheric pressure (first reaction step).

Anhydrous trimellitic acid: 6.4 mass parts (0.03 moles; 20.0 mol % of total moles of polyvalent carboxylic acid)

This material was then added, the pressure inside the reaction tank was reduced to 8.3 kPa, and a reaction was performed for 15 hours with the temperature maintained at 160° C. (second reaction step) to obtain a polyester resin B4 with a weight-average molecular weight (Mw) of 110000.

Crystalline Polyester Resin C1 Manufacturing Example 1,6-hexanediol: 34.5 mass parts (0.29 moles; 100.0 mol % of total moles of polyvalent alcohol)

Dodecanedioic acid: 65.5 mass parts (0.28 moles; 100.0 mol % of total moles of polyvalent carboxylic acid)

These materials were measured into a reaction tank equipped with a cooling tube, an agitator, a nitrogen introduction tube and a thermocouple. Nitrogen gas was substituted inside the flask, the temperature was raised gradually with agitation, and a reaction was performed for 3 hours at 140° C. with agitation.

Tin 2-ethylhexanoate: 0.5 mass parts

This material was then added, the pressure inside the reaction tank was reduced to 8.3 kPa, and a reaction was performed for 4 hours with the temperature maintained at 200° C. to obtain a crystalline polyester resin C1. The resulting crystalline polyester resin C1 had a clear endothermic peak.

Crystalline Polyester Resin C2 Manufacturing Example 1,4-butanediol: 27.4 mass parts (0.29 moles, 100.0 mol % of total moles of polyvalent alcohol)

Tetradecanedioic acid: 72.6 mass parts (0.28 moles: 100.0 mol % of total moles of polyvalent carboxylic acid)

These materials were measured into a reaction tank equipped with a cooling tube, an agitator, a nitrogen introduction tube and a thermocouple. Nitrogen gas was substituted inside the flask, the temperature was raised gradually with agitation, and a reaction was performed for 3 hours at 140° C. with agitation.

Tin 2-ethylhexanoate: 0.5 mass parts

This material was then added, the pressure inside the reaction tank was reduced to 8.3 kPa, and a reaction was performed for 4 hours with the temperature maintained at 200° C. to obtain a crystalline polyester resin C2. The resulting crystalline polyester resin C2 had a clear endothermic peak.

Crystalline Polyester Resin C3 Manufacturing Example 1,8-octanediol: 42.0 mass parts (0.29 moles, 100.0 mol % of total moles of polyvalent alcohol)

Sebacic acid: 58.0 mass parts (0.29 moles: 100.0 mol % of total moles of polyvalent carboxylic acid)

These materials were measured into a reaction vessel equipped with a cooling tube, an agitator, a nitrogen introduction tube and a thermocouple. Nitrogen gas was substituted inside the flask, the temperature was raised gradually with agitation, and a reaction was performed for 3 hours at 140° with agitation.

Tin 2-ethylhexanoate: 0.5 mass parts

This material was then added, the pressure inside the reaction tank was reduced to 8.3 kPa, and a reaction was performed for 4 hours with the temperature maintained at 200° C. to obtain a crystalline polyester resin C3. The resulting crystalline polyester resin C3 had a clear endothermic peak.

Crystalline Polyester Resin C4 Manufacturing Example 100 g of propylene glycol was prepared as an alcohol component and 100 g of terephthalic acid as an acid component, and these were reacted under conditions of 200° C.×6 hours in a flask equipped with a nitrogen introduction tube and a dewatering tube. The atmospheric pressure was then changed to 8 kPa, the reaction was continued for a further one hour, and the resulting reaction product was taken as crystalline polyester resin C4. The resulting crystalline polyester resin C4 exhibited a clear endothermic peak.

Vinyl Resin Polymer D Manufacturing Example

| | |
|---|---|
| Polyethylene having 1 or more unsaturated bonds (Mw: 1400, Mn: 850, DSC endothermic peak: 100° C.) | 20 mass parts |
| Styrene | 59 mass parts |
| n-butyl acrylate | 18.5 mass parts |
| Acrylonitrile | 2.5 mass parts |

These raw materials were loaded into an autoclave, nitrogen was substituted inside the system, and the mixture was maintained at 180° C. with warming and agitation. 50 mass parts of a 2 mass % xylene solution of di-tert-butylperoxide were dripped into the system continuously for 5 hours, and after cooling the solvent was separated and removed to obtain a vinyl resin polymer D comprising a copolymer grafted to polyethylene. The resulting vinyl resin polymer D had a softening point of 110° C. and a glass transition temperature of 64° C., and the molecular weights of the polymer D according to GPC of the THF soluble matter were 7400 weight-average molecular weight (Mw) and 2800 number-average molecular weight (Mn). A peak corresponding to the polyethylene of the raw materials having one or more unsaturated bonds was not confirmed.

Toner Manufacturing Example 1

| | |
|---|---|
| Amorphous polyester resin A1 | 70 mass parts |
| Amorphous polyester resin B1 | 30 mass parts |
| Crystalline polyester resin C1 | 7.5 mass parts |
| Vinyl resin polymer D | 5 mass parts |
| Hydrocarbon wax (maximum endothermic peak temperature 78° C.) | 5 mass parts |
| C.I. pigment blue 15:3 | 5 mass parts |
| 3,5-di-t-butylsalicylic acid aluminum compound | 0.5 mass parts |

The raw materials of this formulation were mixed with a Henschel mixer (FM-75, Mitsui Mining Co., Ltd.) at a rotational speed of 20 $s^{-1}$ for a rotation time of 5 minutes, and then kneaded in a twin screw extruder (PCM-30, Ikegai Corp.) with the temperature set at 135° C. The resulting kneaded product was cooled at a cooling speed of 15° C./min, and coarsely pulverized in a hammer mill to 1 mm or less. The resulting coarsely pulverized product was finely pulverized in a mechanical pulverizer (T-250, Turbo Kogyo Co., Ltd.). This was then classified using a rotary classifier (200TSP, Hosokawa Micron Corporation) to obtain toner particles. For the operating conditions of the rotary classifier (200TSP, Hosokawa Micron Corporation), the rotational speed of the classifying rotor was 50.0 $s^{-1}$. The resulting toner particles had a weight-average particle diameter (D4) of 5.7 μm.

0.5 mass parts of silica fine particles with a primary average particle diameter of 110 nm were added to 100 mass parts of the resulting toner particles, and mixed for a rotation time of 10 minutes at a rotational speed of 30 $s^{-1}$ in a Henschel mixer (FM-75, Mitsui Mining Co., Ltd.). Heat treatment was performed using the resulting mixture with the surface treatment apparatus shown in FIG. 4 to obtain heat-treated toner particles. The operating conditions were feed=5 kg/hr, hot air current temperature=145° C., hot air flow rate=6 $m^3$/min, cool air current temperature=0° C., cool air flow rate=4 $m^3$/min, cool air absolute moisture content=3 g/$m^3$, blower air volume=20 $m^3$/min, injection air flow=1 $m^3$/min. The weight-average particle diameter (D4) of the resulting heat-treated toner particles was 6.2 μm.

1.0 mass parts of silica fine particles with a primary average particle diameter of 13.0 nm were added to 100 mass parts of the resulting heat-treated toner particles, which were then mixed for 5 min in a Henschel mixer (FM75, Mitsui Miike Chemical Engineering Machinery, Co., Ltd.,) at a peripheral velocity of 45 m/sec, and passed through a 54 μm mesh ultrasound shaking sieve to obtain a Toner 1.

Toner Manufacturing Examples 2 to 19

Toners 2 to 19 were manufactured as in toner manufacturing example 1 apart from the amounts and type of the resin A, resin B and resin C, the kneading temperature, the cooling speed after kneading, the heat treatment temperature and the cooling temperature after heat treatment. Table 1 shows the material formulations and manufacturing conditions.

Toner Manufacturing Example 20

| | |
|---|---|
| Amorphous polyester resin A5 | 100 mass parts |
| Crystalline polyester resin C4 | 10 mass parts |
| Copper phthalocyanine pigment | 5 mass parts |
| Salicylic acid chromium complex | 1 mass part |

These raw materials were mixed with a Henschel mixer. Next, these raw materials (mixture) were kneaded with a twin screw extruder (PCM-30, Ikegai Corp.) set to 150° C.

The kneaded product extruded from the discharging port was cooled. The cooled kneaded product was coarsely pulverized (average particle diameter 1 to 2 mm), and then finely pulverized. A hammer mill was used for coarse pulverization, and a jet mill for fine pulverization of the kneaded product. The resulting pulverized product was classified with an air classifier. The classified pulverized product (powder for toner manufacture) was then subjected to heat sphering treatment. Heat sphering treatment was performed with a heat sphering apparatus (Nippon Pneumatic Mfg. Co., Ltd., SFS3). The temperature of the atmosphere during heat sphering treatment was 300° C. The hot air current flow rate was 1.0 $m^3$/min (cross sectional area of hot air current=$1.26\times10^{-3}$ $m^2$, length of heat treatment zone about 0.4 m). The raw material input was 1.0 kg/hr, and the contact time with the hot air current was 0.03 seconds.

1.2 mass parts of silica were then added to 100 mass parts of the heat-treated toner particles, which were then mixed in a Henschel mixer to obtain a Toner 20. The average particle diameter of the final toner was 8.0 μm.

TABLE 1

(Toner formulations and manufacturing conditions)

| | Resin A No. | Resin B No. | Crystalline resin No. | Kneading and discharge temperature (° C.) | Cooling speed after kneadding (° C./min) | heat treatment apparatus Hot air current temperature (° C.) | heat treatment apparatus Cooling temperature (° C.) |
|---|---|---|---|---|---|---|---|
| Toner 1 | A1 | B1 | C1 | 135 | 15 | 145 | 0 |
| Toner 2 | A1 | B1 | C1 | 135 | 15 | 160 | −5 |
| Toner 3 | A1 | B1 | C1 | 150 | 17 | 160 | −5 |
| Toner 4 | A1 | B1 | C2 | 135 | 15 | 145 | 0 |
| Toner 5 | A3 | B3 | C3 | 135 | 10 | 145 | −5 |
| Toner 6 | A2 | B2 | C1 | 135 | 15 | 145 | 0 |
| Toner 7 | A3 | B3 | C1 | 135 | 10 | 145 | −5 |
| Toner 8 | A2 | B2 | C1 | 135 | 20 | 145 | 0 |
| Toner 9 | A3 | B3 | C1 | 135 | 6 | 145 | 8 |
| Toner 10 | A1 | B1 | C1 | 135 | 15 | 145 | −15 |
| Toner 11 | A1 | B1 | C1 | 135 | 15 | 145 | −20 |
| Toner 12 | A1 | B1 | C1 | 135 | 18 | 145 | 16 |
| Toner 13 | A1 | B1 | C1 | 135 | 24 | 145 | −15 |
| Toner 14 | A1 | B1 | C1 | 135 | 15 | 145 | −36 |
| Toner 15 | A1 | B1 | C1 | 135 | 15 | 145 | 21 |
| Toner 16 | A1 | B1 | C1 | 135 | 15 | No treatment | |
| Toner 17 | A2 | B2 | C1 | 135 | 30 | No treatment | |
| Toner 18 | A3 | B3 | C1 | 135 | 6 | No treatment | |
| Toner 19 | A1 | B1 | — | 135 | 15 | No treatment | |
| Toner 20 | A5 | — | C4 | 150 | 25 | 300 | 10 |

The various analysis results for the resulting toners are shown in Table 2.

TABLE 2

(Physical properties of toners)

| | Toner No. | Weight-average particle diameter D4 of toner particles (μm) | Softening point Tm (° C.) | Ls (nm) | Li (nm) | Li/Ls | Aspect ratio of crystalline polyester crystals in toner interior | Maximum number distribution of major axis lengths of crystalline polyester in toner surface layer (nm) | Maximum number distribution of major axis lengths of crystalline polyester in toner interior (nm) |
|---|---|---|---|---|---|---|---|---|---|
| Example 1 | 1 | 6.4 | 97 | 79 | 160 | 2.03 | 16.0 | 80 | 120 |
| Example 2 | 2 | 6.4 | 98 | 81 | 162 | 2.00 | 16.2 | 20 | 120 |
| Example 3 | 3 | 6.4 | 97 | 80 | 159 | 1.99 | 15.9 | 20 | 20 |
| Example 4 | 4 | 6.4 | 97 | 82 | 156 | 1.90 | 5.2 | 80 | 120 |
| Example 5 | 5 | 6.4 | 99 | 81 | 299 | 3.69 | 37.4 | 80 | 225 |
| Example 6 | 6 | 6.4 | 97 | 40 | 60 | 1.50 | 6.0 | 40 | 45 |
| Example 7 | 7 | 6.4 | 97 | 78 | 300 | 3.85 | 30.0 | 80 | 225 |
| Reference Example 8 | 8 | 6.4 | 99 | 41 | 51 | 1.24 | 5.1 | 40 | 40 |
| Reference Example 9 | 9 | 6.4 | 97 | 100 | 329 | 3.29 | 32.9 | 100 | 250 |
| Example 10 | 10 | 6.4 | 98 | 52 | 157 | 3.02 | 15.7 | 50 | 120 |
| Example 11 | 11 | 6.4 | 97 | 42 | 159 | 3.79 | 15.9 | 40 | 120 |
| Example 12 | 12 | 6.4 | 97 | 110 | 141 | 1.28 | 14.1 | 110 | 105 |
| Example 13 | 13 | 6.4 | 98 | 50 | 99 | 1.98 | 9.9 | 50 | 75 |
| Comparative Example 1 | 14 | 6.4 | 97 | 33 | 155 | 4.70 | 15.5 | 30 | 120 |
| Comparative Example 2 | 15 | 6.4 | 98 | 123 | 157 | 1.28 | 15.7 | 120 | 120 |
| Comparative Example 3 | 16 | 6.4 | 97 | 159 | 157 | 0.99 | 15.7 | 160 | 120 |
| Comparative Example 4 | 17 | 6.4 | 98 | 31 | 30 | 0.97 | 3.0 | 30 | 30 |
| Comparative Example 5 | 18 | 6.4 | 97 | 332 | 330 | 0.99 | 33.0 | 330 | 250 |
| Comparative Example 6 | 19 | 6.4 | 104 | — | — | — | — | — | — |
| Comparative Example 7 | 20 | 8.0 | 101 | 28 | 29 | 1.04 | 2.9 | 30 | 30 |

Ls: Number-average diameter of major axis lengths of crystalline polyester resin in toner surface layer Li: Number-average diameter of major axis lengths of crystalline polyester resin in toner interior

Magnetic Core Particle Manufacturing Example

Step 1 (Weighing and Mixing Step)

Ferrite raw materials were weighed in the following amounts:

| | |
|---|---|
| $Fe_2O_3$ | 60.2 mass % |
| $MnCO_3$ | 33.9 mass % |
| $Mg(OH)_2$ | 4.8 mass % |
| $SrCO_3$ | 1.1 mass % |

These were then pulverized and mixed for 2 hours in a dry ball mill using zirconia (φ10 mm) balls.

Step 2 (Pre-Baking Step)

After pulverization and mixing, this was fired for 3 hours at 1000° C. in atmosphere in a burner-type firing furnace to prepare pre-baked ferrite. The ferrite composition was as follows:

$$(MnO)a(MgO)b(SrO)c(Fe_2O_3)\ d$$

In the formula, a=0.39, b=0.11, c=0.01, d=0.50.

Step 3 (Pulverization Step)

After being pulverized to about 0.5 mm in a crusher, this was pulverized for 2 hours in a wet ball mill using zirconia (φ10 mm) balls with 30 mass parts of water added per 100 mass parts of the pre-baked ferrite.

This slurry was pulverized for 4 hours in a wet ball mill using zirconia (φ1.0 mm) balls to obtain a ferrite slurry.

Step 4 (Granulation Step)

2.0 mass parts of polyvinyl alcohol per 100 mass parts of the pre-baked slurry was added as a binder to the ferrite slurry, which was then granulated into roughly 36 μm spherical particles in a spray dryer (manufactured by Ohkawara Kakohki Co., Ltd.).

Step 5 (Main Baking Step)

This was then baked for 4 hours at 1150° C. in an electrical oven in a nitrogen atmosphere (oxygen concentration 1.00 vol % or less) to control the baking atmosphere.

Step 6 (Selection Step)

Aggregated particles were crushed, and coarse particles were removed by sieving in a 250 μm mesh sieve to obtain magnetic core particles 1.

Coating Resin Manufacturing Example

| | |
|---|---|
| Cyclohexyl methacrylate monomer | 26.8 mass parts |
| Methyl methacrylate monomer | 0.2 mass parts |
| Methyl methacrylate macromonomer (macromonomer with a weight-average molecular weight of 5000 having methacryloyl group at one end) | 8.4 mass parts |
| Toluene | 31.3 mass parts |
| Methyl ethyl ketone | 31.3 mass parts |

These materials were added to a four-neck flask with an attached reflux condenser, thermometer, nitrogen introduction tube and agitator, and nitrogen gas was introduced to obtain an adequate nitrogen atmosphere. This was then heated to 80° C., 2.0 mass parts of azobisisobutyronitrile were added, and the mixture was refluxed for 5 hours to perform polymerization. Hexane was injected into the resulting reaction product to precipitate the copolymer, and the precipitate was filtered out and vacuum dried to obtain a coating resin.

Magnetic Carrier Manufacturing Example

| | |
|---|---|
| Coating resin | 20.0 mass % |
| Toluene | 80.0 mass % |

These materials were dispersed and mixed in a bead mill to obtain a resin liquid.

100 mass parts of magnetic core particles were placed in a Nauta mixer, and the resin liquid was then added to the Nauta mixer to 2.0 mass parts as the resin component. This was heated at 70° C. under reduced pressure, mixed at 100 rpm, and subjected to solvent removal and coating for 4 hours. The resulting sample was transferred to a Julia mixer, heat treated for 2 hours at 100° C. in a nitrogen atmosphere, and classified with a 70 μm mesh sieve to obtain a magnetic carrier. The 50% particle diameter (D50) of the resulting magnetic carrier based on volume distribution was 38.2 μm.

The above toners 1 to 20 were each mixed with this magnetic carrier in a V-type mixer (V-10: Tokuju Corporation) at 0.5 $s^{-1}$ for 5 minutes to a toner concentration of 8.0 mass % to obtain two-component developers 1 to 20. The two-component developers 1 to 20 were used to perform the following evaluation.

Evaluation of Fixability (Hot Offset Resistance, Low-Temperature Fixability)

A Canon imageRUNNER ADVANCE C5051 full color copier was modified so that the fixing temperature could be set at will, and the fixing temperature regions were tested. The images were adjusted in monochrome mode so that the toner laid-on level on the paper was 0.8 mg/$cm^2$ in a normal temperature, normal humidity environment (23° C., 50% Rh), and unfixed images were prepared. The evaluation paper was GF-0081 copy paper (A4, weight 81.4 g/$m^2$, purchased from Canon Marketing Japan Inc.), and images were formed with an image printing ratio of 25%. The fixing temperature was then raised from 110° C. in increments of 1° C., and the temperature range at which no offset occurred (from the fixable temperature to below the temperature at which offset occurred) was given as the fixable range, while the lowest temperature within this range was given as the lowest fixing temperature, and the highest temperature as the hot offset resistance temperature.

(Evaluation Standard: Hot Offset Resistance)

A: 225° C. or more (Excellent)

B: 210° C. to less than 225° C. (Very good)

C: 195° C. to less than 210° C. (Good)

D: 170° C. to less than 195° C. (Level of prior art)

E: Less than 170° C. (Poor)

(Evaluation Standard: Low-Temperature Fixability)

A: Less than 120° C. (Excellent)

B: 120° C. to less than 135° C. (Very good)

C: 135° C. to less than 150° C. (Good)

D: 150° C. to less than 170° C. (Level of prior art)

E: 170° C. or more (Poor)

Evaluation of Development in Low-Humidity Environments

Using a Canon imageRUNNER ADVANCE C5051 full color copier as the image-forming apparatus, developability in low-humidity environments was evaluated in a normal temperature, low humidity environment (23° C., 5% RH). To evaluate developability, a developing apparatus loaded with developers 1 to 20 was idled for 2 minutes. The latent image of the exposed part of the photoreceptor was developed with a dark part potential (background potential) of the photoreceptor of −700 V, a light part potential (image potential) of −230 V, a developing bias (DC component) of −580 V, and a frequency of 8 kHz/1.2 kVpp of the AC component (rectangular wave). The surface potential of the photoreceptor was then measured, and the developing charge efficiency was measured. The developing charge efficiency is represented as the photoreceptor potential after toner development/the photoreceptor exposure potential before toner development×100(%), and indicates how much of the latent potential is buried by the toner.

Toner (fogging) adhering to the background part (white part) of the photoreceptor after development was collected by taping, and the adhering amount was measured with a photovoltaic reflection densitometer (trade name TC-6DS/A, Tokyo Denshoku Co., Ltd.).

(Evaluation Standard: Low-Temperature Developing Charge Efficiency)

A: 98% or more (Very good)

B: 95% to less than 98% (Good)

C: 85% to less than 95% (Level of prior art)

D: Less than 85% (Poor)

(Evaluation Standard: Low-Humidity Fogging)

A: Less than 0.05 (Excellent)

B: 0.05 to less than 0.10 (Very good)

C: 0.10 to less than 0.30 (Level of prior art)

D: 0.30 or more (Poor)

(Evaluation of Toner Scattering in High-Humidity Environments)

An evaluation of toner scattering in the developing device was performed with a Canon imageRUNNER ADVANCE C5051 full color copier as the developing device in a high-temperature, high-humidity environment (30° C./80% Rh). This was used to output 1000 sheets of a horizontal lined chart with an image ratio of 5%, and then left for 1 week in the same high humidity environment. After this period the copier was started up again, the developing apparatus alone was idled for 30 seconds in the image-forming apparatus, toner adhering to the facing photoreceptor surface was collected with tape, and the adhering amount was measured with a photovoltaic reflection densitometer (trade name TC-6DS/A, Tokyo Denshoku Co., Ltd.).

(Evaluation Standard: Toner Scatter Fogging)

A: Less than 0.25 (Excellent)

B: 0.25 to less than 0.50 (Good)

C: 0.50 or more (Level of prior art)

The results of a toner evaluation using these evaluation methods and standards are shown in Table 3.

TABLE 3

| | Evaluation Results | | | | | |
|---|---|---|---|---|---|---|
| | Developer No. | Low-temperature fixability | Hot offset resistance | Low-humidity developing efficiency | Low-humidity fogging | High-humidity toner scatter |
| Example 1 | 1 | A (113° C.) | A (229° C.) | A (99%) | A (0.03) | A (0.12) |
| Example 2 | 2 | A (116° C.) | A (228° C.) | A (98%) | C (0.11) | A (0.12) |
| Example 3 | 3 | A (116° C.) | B (216° C.) | A (98%) | C (0.12) | A (0.13) |
| Example 4 | 4 | A (115° C.) | A (226° C.) | A (98%) | A (0.04) | C (0.65) |
| Example 5 | 5 | A (115° C.) | B (212° C.) | A (98%) | A (0.04) | C (0.65) |
| Example 6 | 6 | A (115° C.) | B (214° C.) | A (99%) | C (0.12) | B (0.30) |
| Example 7 | 7 | B (126° C.) | B (217° C.) | A (99%) | A (0.04) | B (0.30) |
| Reference Example 8 | 8 | B (124° C.) | C (208° C.) | B (96%) | C (0.13) | C (0.65) |
| Reference Example 9 | 9 | A (115° C.) | C (206° C.) | A (99%) | A (0.04) | C (0.65) |
| Example 10 | 10 | A (114° C.) | A (228° C.) | A (99%) | B (0.08) | A (0.14) |
| Example 11 | 11 | B (125° C.) | A (228° C.) | B (96%) | C (0.12) | A (0.15) |
| Example 12 | 12 | B (126° C.) | A (225° C.) | B (96%) | A (0.04) | A (0.15) |
| Example 13 | 13 | A (118° C.) | B (218° C.) | A (99%) | B (0.08) | A (0.13) |
| Comparative Example 1 | 14 | C (136° C.) | A (227° C.) | B (96%) | C (0.16) | B (0.36) |
| Comparative Example 2 | 15 | B (123° C.) | A (227° C.) | C (89%) | C (0.16) | B (0.41) |
| Comparative Example 3 | 16 | C (137° C.) | A (225° C.) | C (88%) | C (0.17) | B (0.39) |
| Comparative Example 4 | 17 | C (138° C.) | D (182° C.) | C (89%) | C (0.17) | C (0.65) |
| Comparative Example 5 | 18 | C (139° C.) | D (186° C.) | C (86%) | C (0.20) | C (0.73) |
| Comparative Example 6 | 19 | D (155° C.) | D (180° C.) | C (85%) | C (0.16) | C (0.68) |
| Comparative Example 7 | 20 | C (137° C.) | D (180° C.) | C (89%) | C (0.18) | C (0.62) |

As shown by these results, the toner of the invention has excellent fixability and developability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-120189, filed Jun. 15, 2015, and Japanese Patent Application No. 2016-108580, filed May 31, 2016, which are hereby incorporated by reference herein in their entirety.

What is claimed is:

1. A toner comprising a toner particle containing a crystalline polyester resin and an amorphous polyester resin, the crystalline polyester resin being dispersed as crystal domains in the amorphous polyester resin, wherein in a cross-sectional observation of the toner by transmission electron microscopy (TEM), a first number-average diameter (D1) of major axis lengths of the crystal domain dispersed up to a depth of 0.30 μm from a toner surface is from 40 nm to 110 nm, and a second number-average diameter (D1) of major axis lengths of the crystal domains dispersed deeper than 0.30 μm from the toner surface is from 60 nm to 300 nm, the second number-average diameter (D1) further being from 1.25 to 4.00 times the first number-average diameter (D1).

2. The toner according to claim 1, wherein the aspect ratio of the crystalline polyester resin dispersed deeper than 0.30 μm from the toner surface is from 6.0 to 30.0.

3. The toner according to claim 1, which has a maximum value of from 80 nm to 200 nm in the number distribution of the major axis lengths of the crystalline polyester resin dispersed deeper than 0.30 μm from the toner surface, and has a maximum value of from 50 to 100 nm in the number distribution of the major axis lengths of the crystalline polyester resin dispersed up to a depth of 0.30 μm from the toner surface.

* * * * *